US011654324B2

(12) United States Patent
Lindsay

(10) Patent No.: US 11,654,324 B2
(45) Date of Patent: May 23, 2023

(54) SLIDING GRIP RESISTANCE EXERCISE DEVICE

(71) Applicant: Christopher Todd Lindsay, Lanham, MD (US)

(72) Inventor: Christopher Todd Lindsay, Lanham, MD (US)

(73) Assignee: Christopher Todd Lindsay, Lanham, MD (US)

( * ) Notice: Subject to any disclaimer, the term of this patent is extended or adjusted under 35 U.S.C. 154(b) by 253 days.

(21) Appl. No.: 17/237,113

(22) Filed: Apr. 22, 2021

(65) Prior Publication Data

US 2021/0236875 A1 Aug. 5, 2021

Related U.S. Application Data

(62) Division of application No. 16/449,401, filed on Jun. 23, 2019, now Pat. No. 11,027,167.

(51) Int. Cl.

| | |
|---|---|
| ***A63B 21/05*** | (2006.01) |
| ***A63B 21/16*** | (2006.01) |
| ***A63B 1/00*** | (2006.01) |
| ***A63B 21/068*** | (2006.01) |
| ***A63B 21/00*** | (2006.01) |
| ***A63B 23/12*** | (2006.01) |
| ***A63B 21/02*** | (2006.01) |
| ***A63B 21/04*** | (2006.01) |
| ***A63B 23/035*** | (2006.01) |

(52) U.S. Cl.

CPC ..... *A63B 21/1636* (2013.01); *A63B 1/00* (2013.01); *A63B 21/023* (2013.01); *A63B 21/0428* (2013.01); *A63B 21/05* (2013.01); *A63B 21/068* (2013.01); *A63B 21/4035* (2015.10); *A63B 23/03525* (2013.01); *A63B 23/1218* (2013.01)

(58) Field of Classification Search

CPC ..... A63B 21/0428; A63B 21/1636; A63B 21/023

See application file for complete search history.

(56) References Cited

U.S. PATENT DOCUMENTS 7,892,158 B2 * 2/2011 Varga ..... A63B 21/4017 482/141
9,079,085 B2 * 7/2015 McBride ..... A63B 21/4035
(Continued)

*Primary Examiner* — Joshua T Kennedy

(57) ABSTRACT

A multi-functional sliding grip exercise device, specifically but not limited to: sliding grip medial pull-ups, sliding grip lateral pull-ups, lower back extension/sit-up assistance exercise. Exercise device will have rotatable rubber pegs attached to horizontal bars to aid in utility. Horizontal bars supporting hand grips will have apertures on its frame; apertures will take on the form of a "T" with arms going vertically down to engage device locking system. Horizontal bar with apertures will have tracks on top surface and bottom surface to support guidance of Hand grips. Horizontal bar with apertures will have a resistance element housed within, preferably but not limited to springs; also housed within bar will be spring caps with an protuberance attached that will make contact with Handgrips appendage to engage springs. Handgrips may have indentations to support lower back bar for lower back extension/sit-up assistance exercise. Device may have adjustable resistance.

12 Claims, 45 Drawing Sheets

(56) References Cited

U.S. PATENT DOCUMENTS

Figure 1:
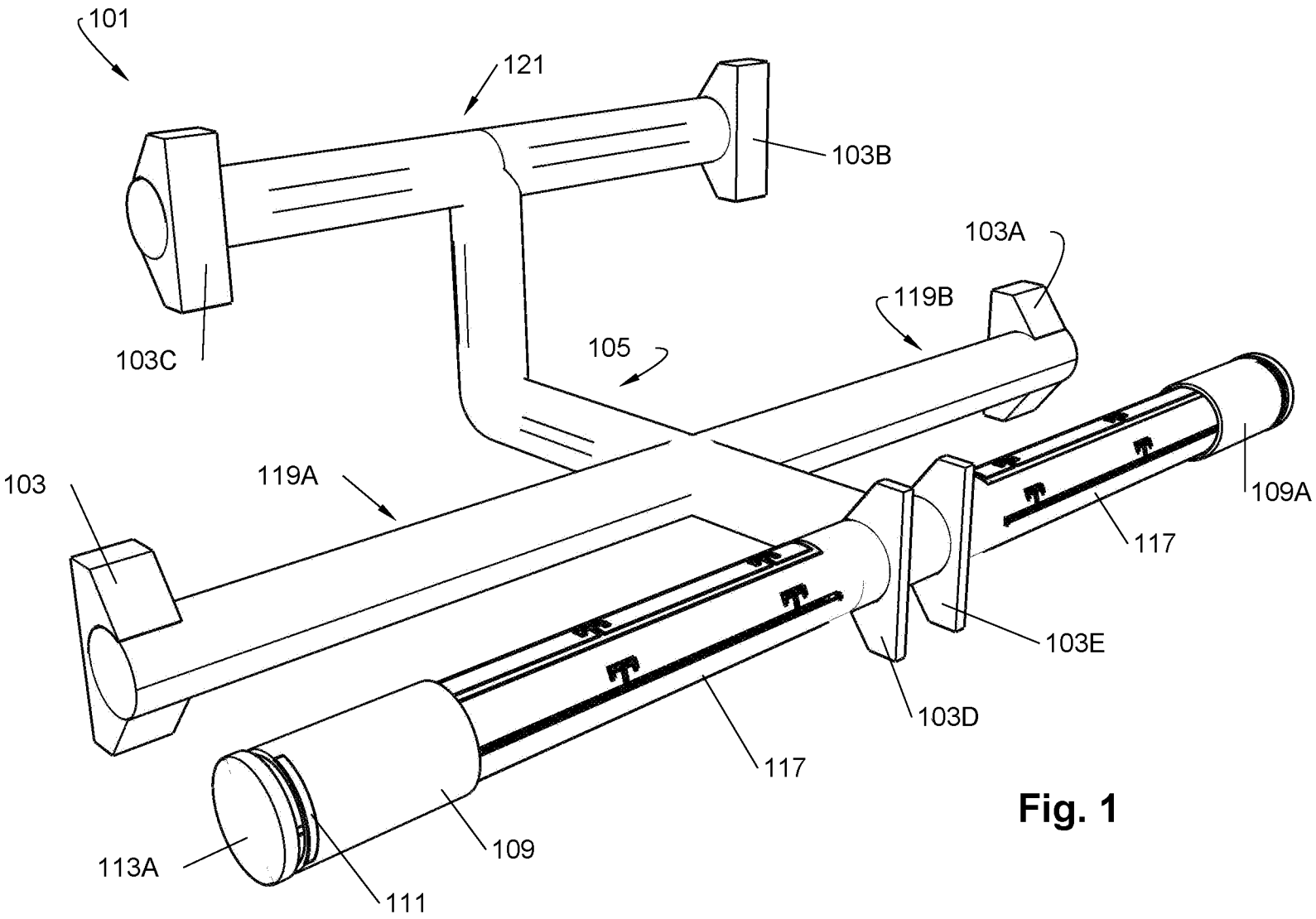

| | | | | |
|---|---|---|---|---|
| 2012/0115683 | A1* | 5/2012 | Ross | A63B 69/0057 482/38 |
| 2013/0196824 | A1* | 8/2013 | Ross | A63B 23/1218 482/40 |
| 2014/0094347 | A1* | 4/2014 | Orakwusi | A63B 23/1218 482/38 |
| 2014/0371040 | A1* | 12/2014 | Vasquez | A63B 23/1236 482/39 |
| 2015/0141214 | A1* | 5/2015 | Morway | A63B 21/4049 482/107 |
| 2016/0166874 | A1* | 6/2016 | Sheeler | A63B 1/00 482/40 |
| 2016/0250512 | A1* | 9/2016 | Siemer | A63B 21/0004 482/139 |
| 2020/0398102 | A1* | 12/2020 | Lindsay | A63B 21/00181 |

* cited by examiner

SLIDING GRIP RESISTANCE EXERCISE DEVICE

CROSS-REFERENCES TO RELATED APPLICATIONS

This application claims priority to and is a divisional of U.S. Nonprovisional patent application Ser. No. 16/449,401 filed Jun. 23, 2019, entitled "Sliding Grip Resistance Exercise Device"

STATEMENT REGARDING FEDERALLY SPONSORED OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISK

Not Applicable

BACKGROUND

Field of Invention

The invention disclosed relates to an exercise device, in particular, a sliding grip resistance exercise device that can be used for but not limited to: medial resistance pull-ups, lateral resistance pull-ups, chin-ups, lower back extension/sit-up assistance exercise.

While pull-up bars have long been revered in the fitness industry as a means to work your biceps and upper back in a pull motion, these devices often neglect your triceps in a push motion and your lower back in extension exercises while also assisting you upright in a full motion sit-up. Also, pull-up bars work with vertical resistance, meaning an users own body weight going up and down, vertical along with horizontal resistance allows a user to work their muscles in a more diverse way. This has left users to purchase multiple devices. There has yet to have been a device that will encompass all, until now.

Related Art

Prior art has consisted of pull-up bars with immobile hand grips that double as a sit-up device; these devices hold the feet of the user flat, once the user is in a horizontal position, or descend back, there is no force that will assist the user back into a vertical position, or ascend up. Prior art has also consisted of pull-up bars with sliding hand grips that do not offer adjustable medial or lateral resistance to work your arms, upper and lower back, with the ability to manually lock hand-grips in a preferred static position, invention disclosed solves that problem. As of now, U.S. Pat. No. 9,044,629 functions as a pull-up bar with sliding grip handles that doubles as a push-up bar with sliding handles. Application publication 2012/0115683 functions as a pull-up bar with two apertures along its frame, two handles protruding from apertures slide along the course of its frame. Current device is disclosed as a pull-up bar, push-up bar, and shoulder press.

BRIEF SUMMARY

There is a need for a more versatile exercise device that will utilize more muscle groups while exercising.

Disclosed fitness device will have at least six rubber pegs attached to its frame, rubber pegs will be utilized for wall and floor support. The cavity of ventral bar supporting handgrips will have two springs, one spring for each respected handgrip. At the lateral ends of each spring will be spring caps, one spring cap will have a protuberance attached to it. The protuberance will allow one spring cap to rotate and compress springs when engaged with handgrips appendage. The protuberance attached to spring caps will also lock into "T" locks if the user would prefer handgrips to be static. Each spring cap protuberance will aid in different exercises depending on the location of spring cap with protuberance, for example, the spring caps with a protuberance at the lateral ends of ventral bar will aid in compressing springs to perform medial sliding pull-ups, while the spring caps with a protuberance at medial ends of ventral bar will compress springs to perform lateral sliding pull-ups or lower back extension/sit-up assistance exercises.

Tracks will be placed on top and bottom surface of bar to stabilize and guide hand grips. In another embodiment sliding function will be aided by ball bearings, placed interiorly of handgrips. Also in another variation fitness device will have knobs to adjust resistance of springs. Aforementioned embodiments and variations can also be found in claimed section of disclosure.

In another embodiment of disclosed invention, the user will be able to perform a lower back extension exercise with sit-up assistance. By rotating rubber pegs attached to fitness device frame, for optimal floor and wall support. The user will place fitness device on the floor leaning it against a vertical support structure, attach lower back apparatus, and engage fitness device.

BRIEF DESCRIPTION OF VIEWS

FIG. 1. Shows a left iso perspective view of fitness device in first embodiment.

Figure 2A:
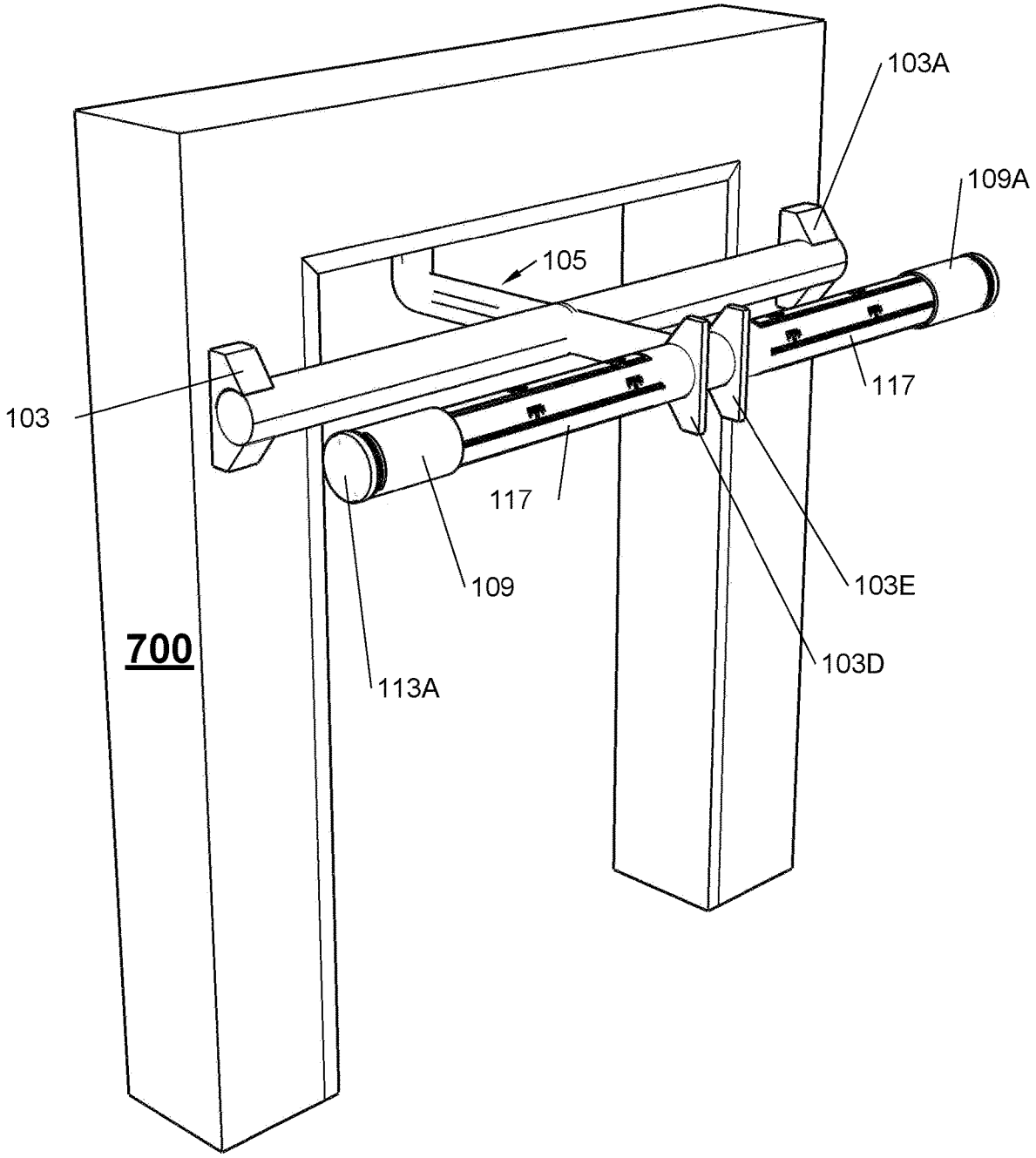

FIG. 2A. Shows a front left iso perspective view of fitness device hanging from door frame.

Figure 2B:
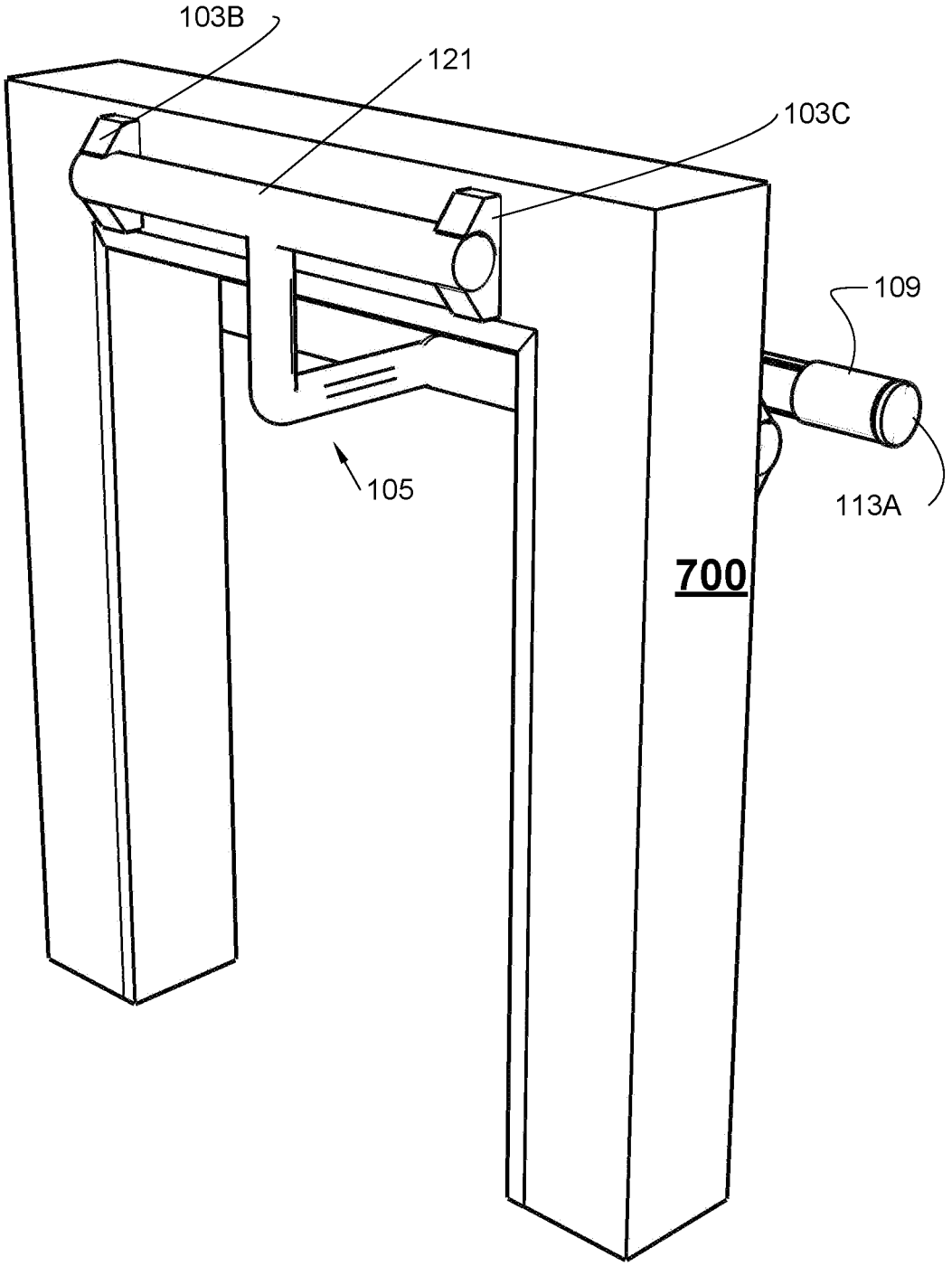

FIG. 2B. Shows a back left iso perspective view of fitness device hanging from door frame.

Figure 3:
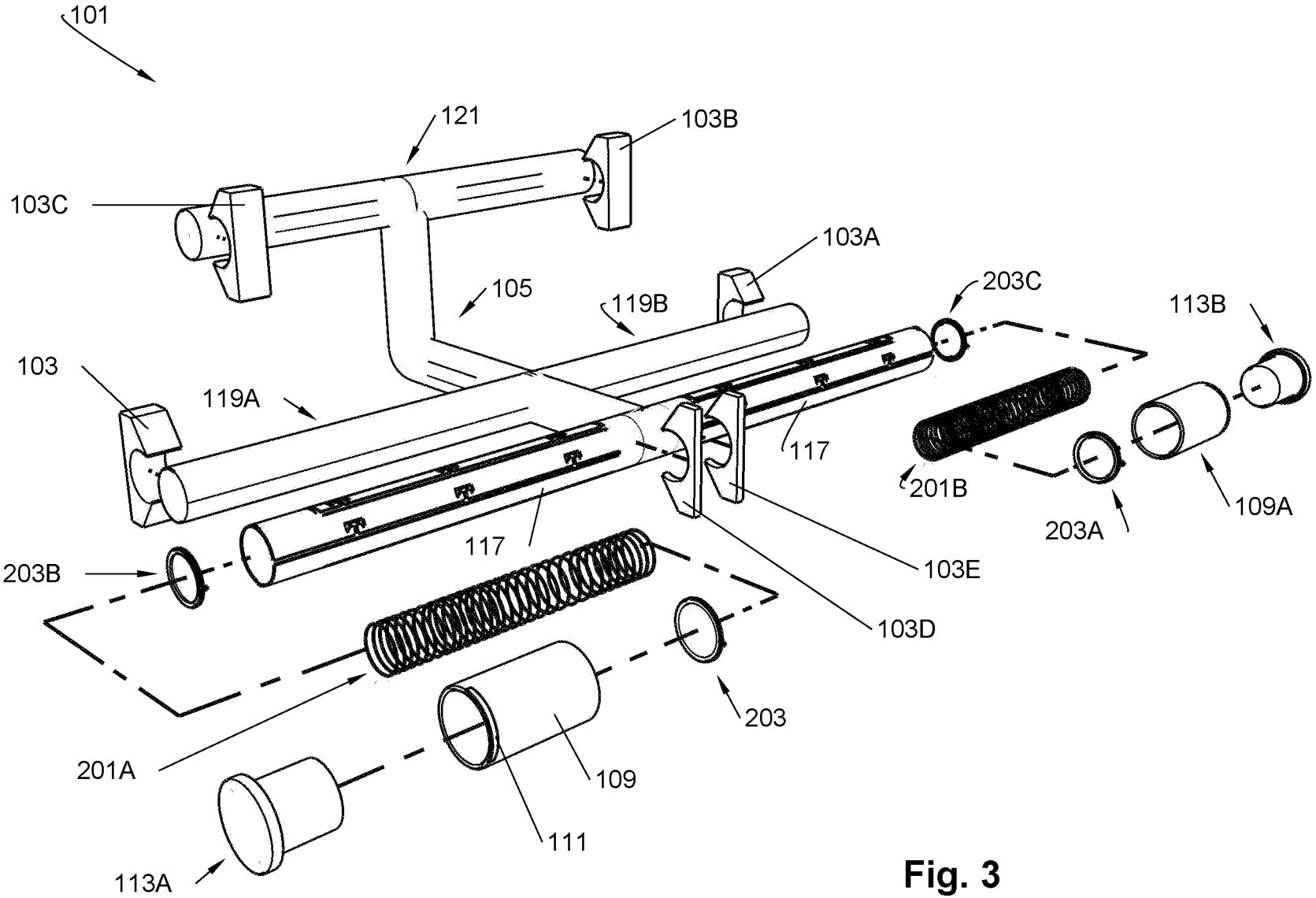

FIG. 3. Shows a front left iso perspective view of fitness device exploded.

Figure 4A:
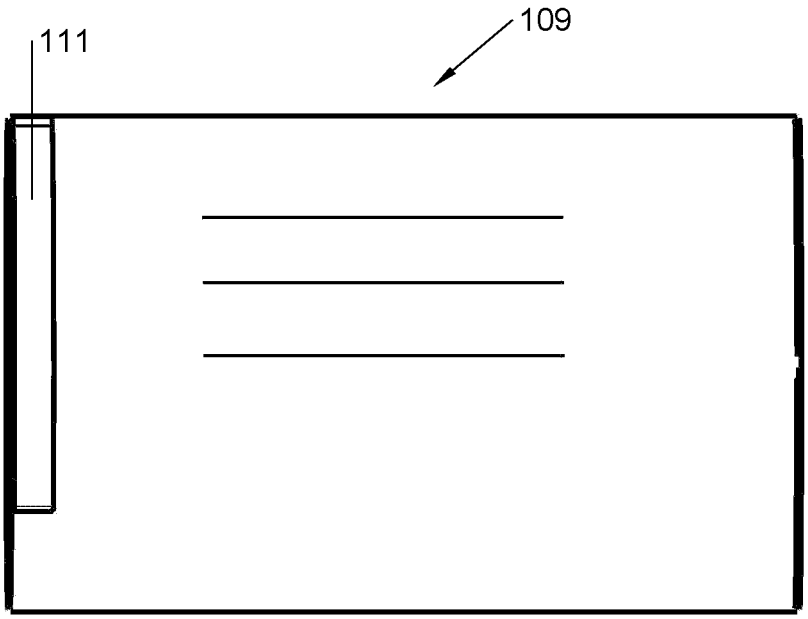

FIG. 4A. Shows a front view of handgrips interior components. Top and bottom projections, and middle appendage.

Figure 4B:
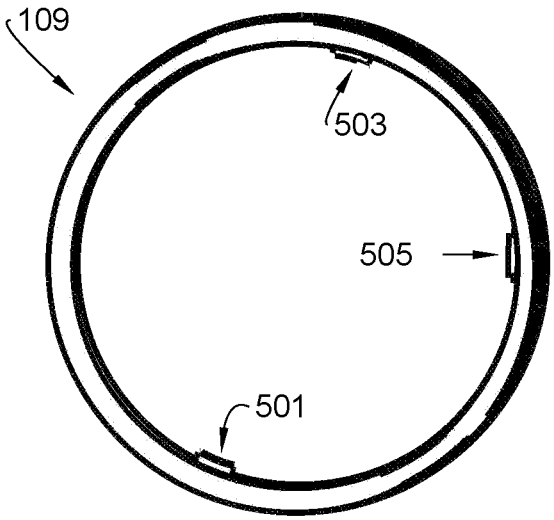

FIG. 4B. Shows a front view of handgrips exterior component, indentation. Indentation will accept lower back bar connector.

Figure 5A:
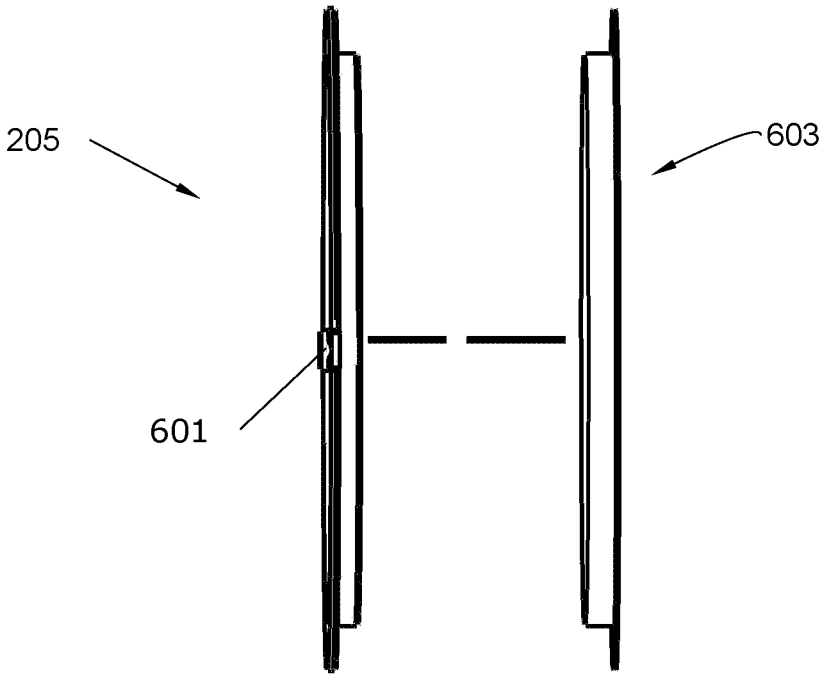

FIG. 5A. Shows a right side view of exploded compression spring cap.

Figure 5B:
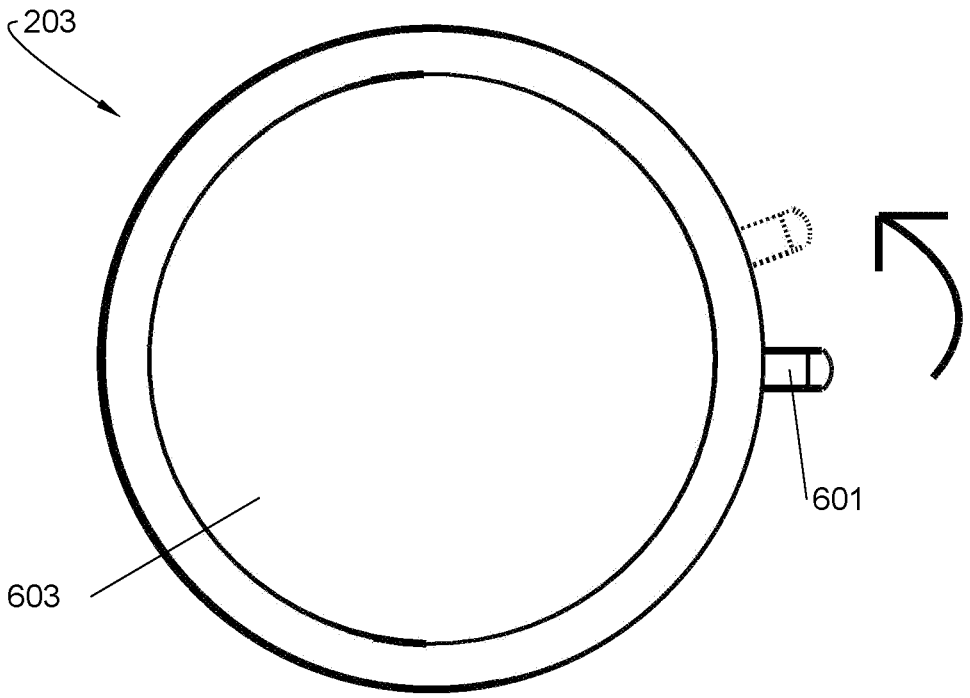

FIG. 5B. Shows a front view of compression spring cap, and how spring cap with the protuberance is capable of rotation.

Figure 6:
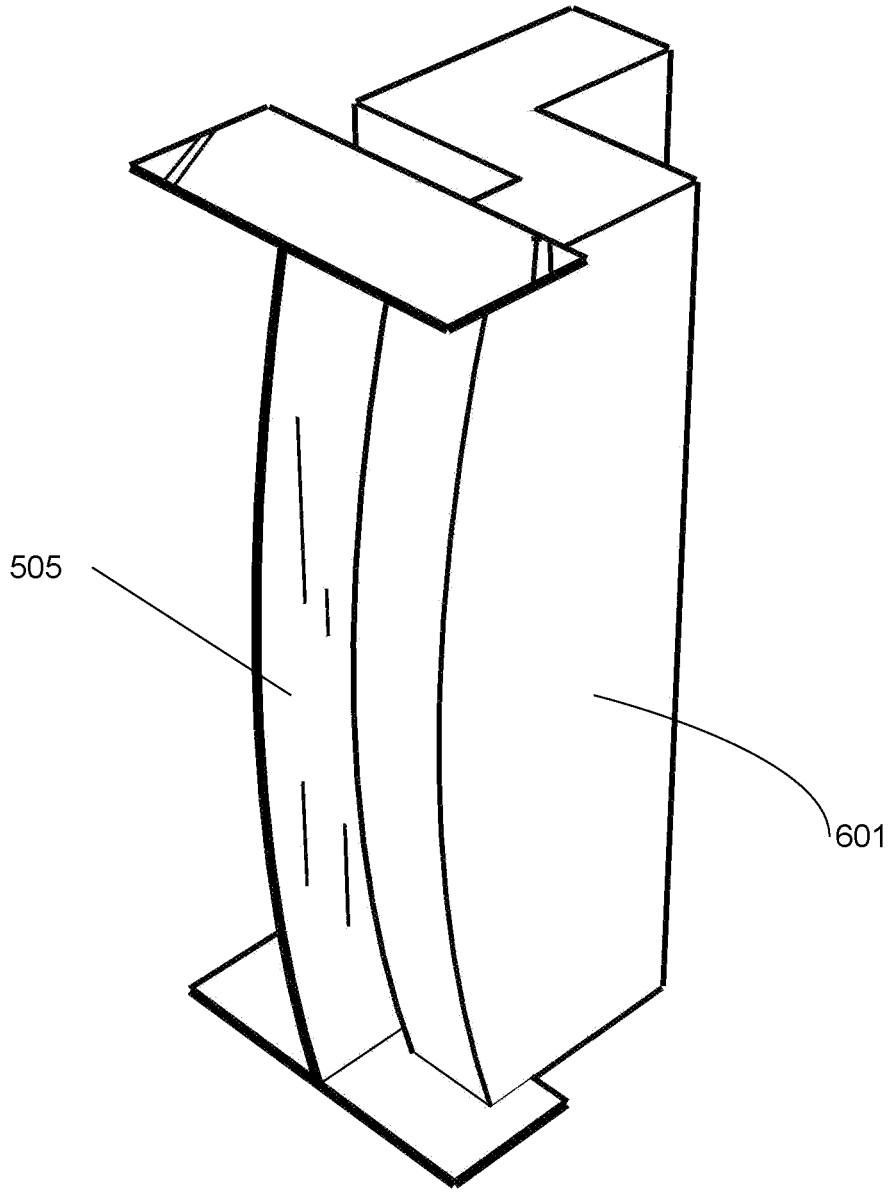

FIG. 6. Shows a front iso view of spring cap protuberance and handgrip appendage relationship.

Figure 7:
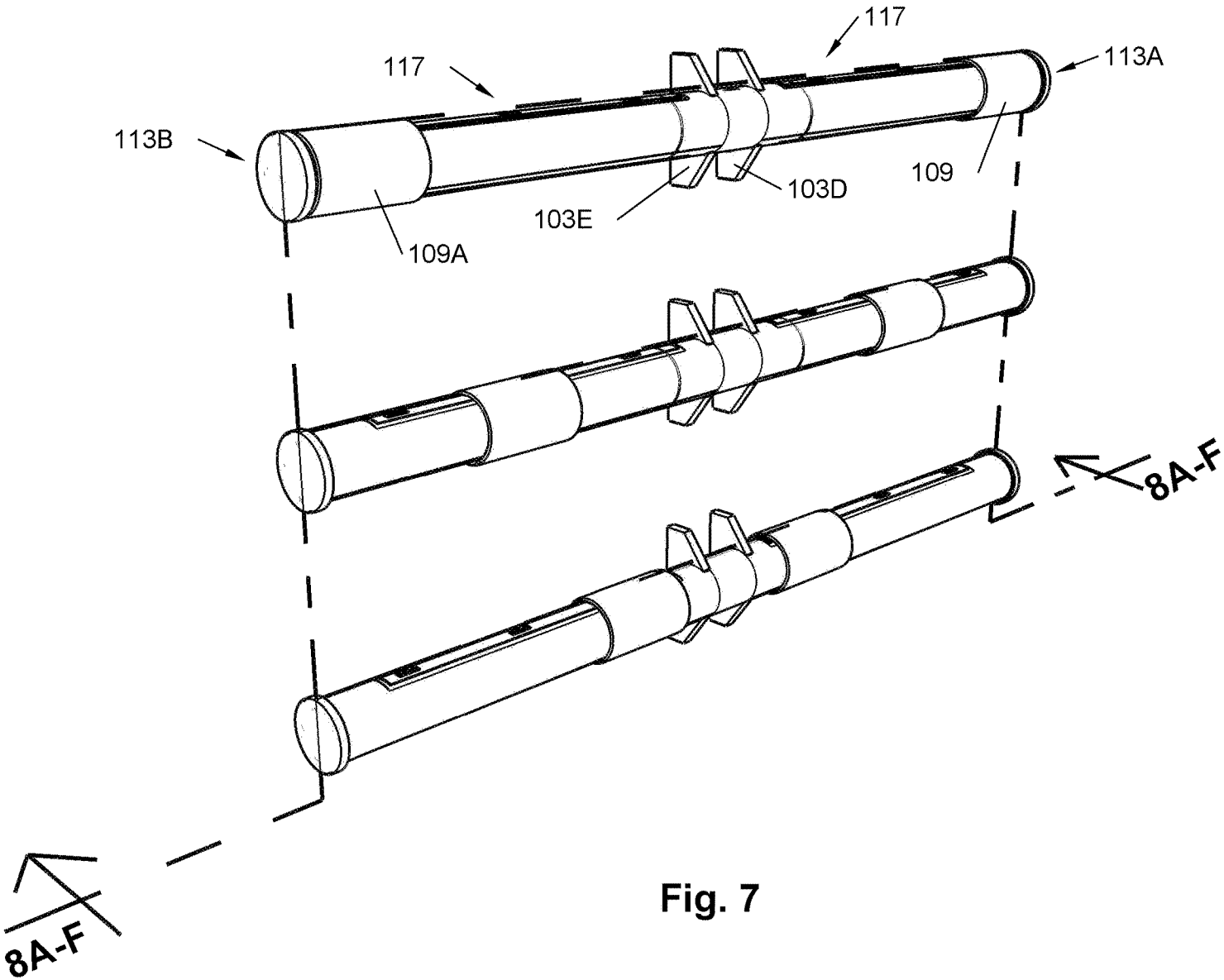

FIG. 7. Shows a back left iso view of three ventral bars sectional cut, and direction of sight for upcoming figures, 8A-F.

Figure 8A:
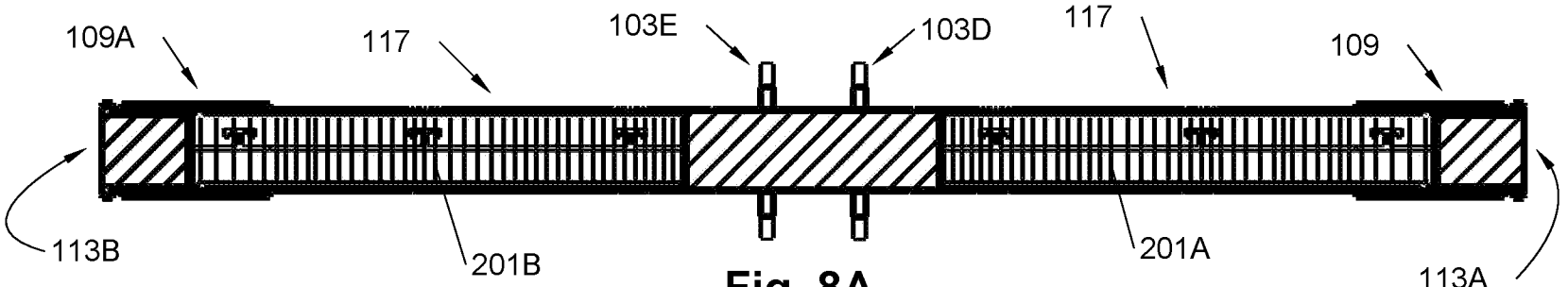

FIG. 8A. Shows a back view sectional of ventral bar in medial pull-up position before compression, with metal hatching of bar and locking cap.

Figure 8B:
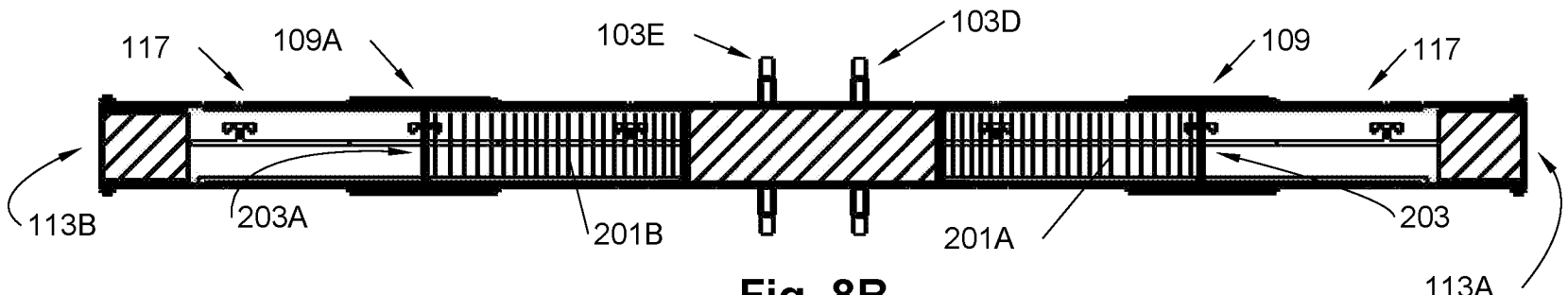

FIG. 8B. Shows a back view sectional cut of ventral bar in medial pull-up position halfway compressed, with metal hatching of bar and locking cap.

Figure 8C:
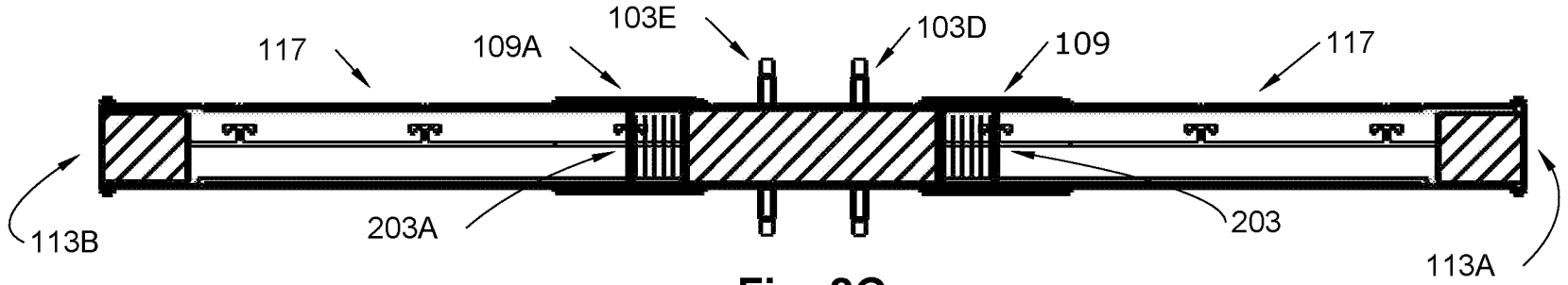

FIG. 8C. Shows a back view sectional cut of ventral bar in medial pull-up position fully compressed, with metal hatching of bar and locking cap.

Figure 8D:
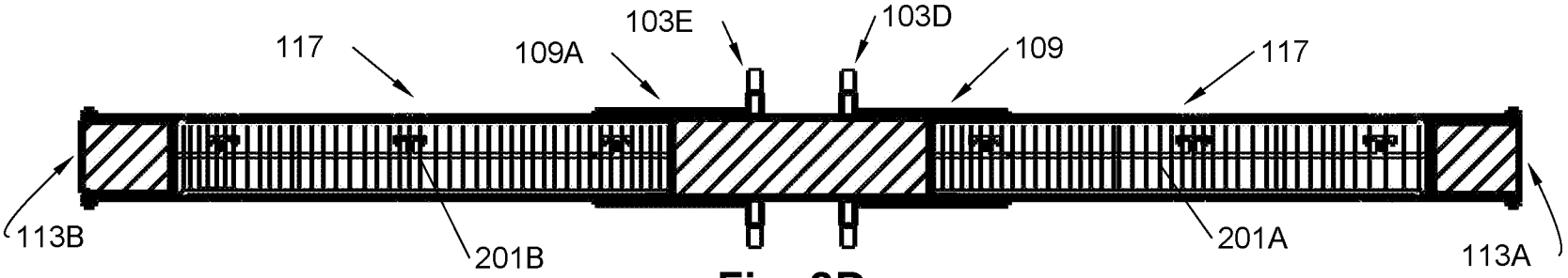

FIG. 8D. Shows a back view sectional cut of ventral bar in lateral pull-up position before compression, with metal hatching of bar and locking cap.

Figure 8E:
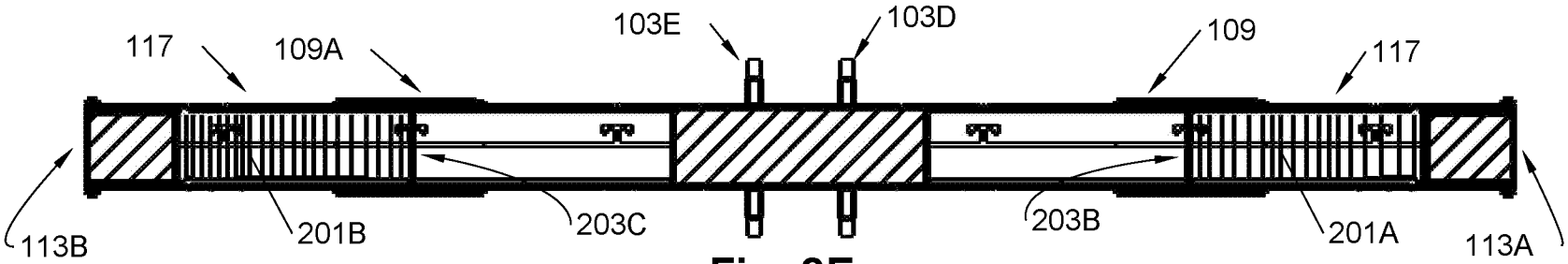

FIG. 8E. Shows a back view sectional cut of ventral bar in lateral pull-up position halfway compressed, with metal hatching of bar and locking cap.

Figure 8F:
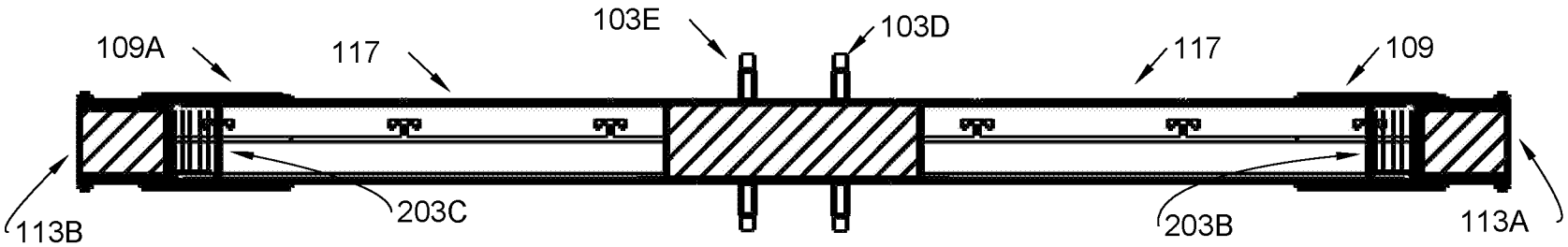

FIG. 8F. Shows a back view sectional cut of ventral bar in lateral pull-up position fully compressed, with metal hatching of bar and locking cap.

Figure 9A:
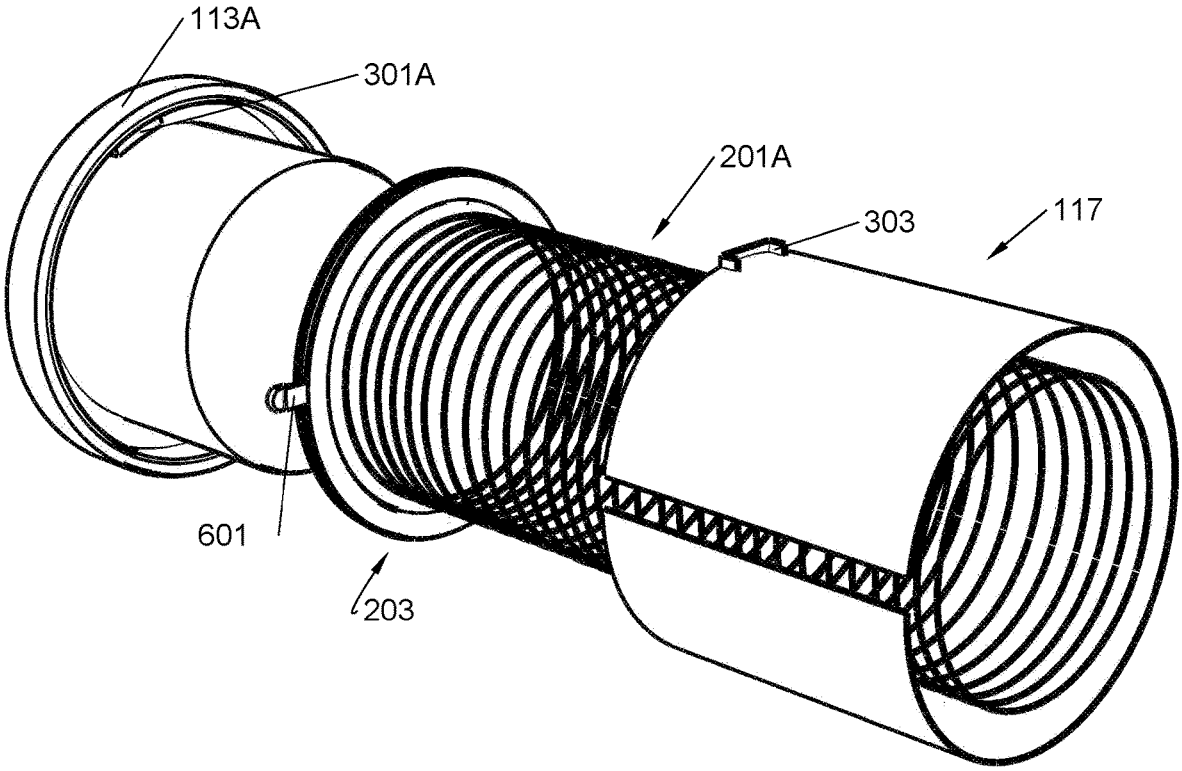

FIG. 9A. Shows a right iso view of locking cap unlocked from ventral bar.

Figure 9B:
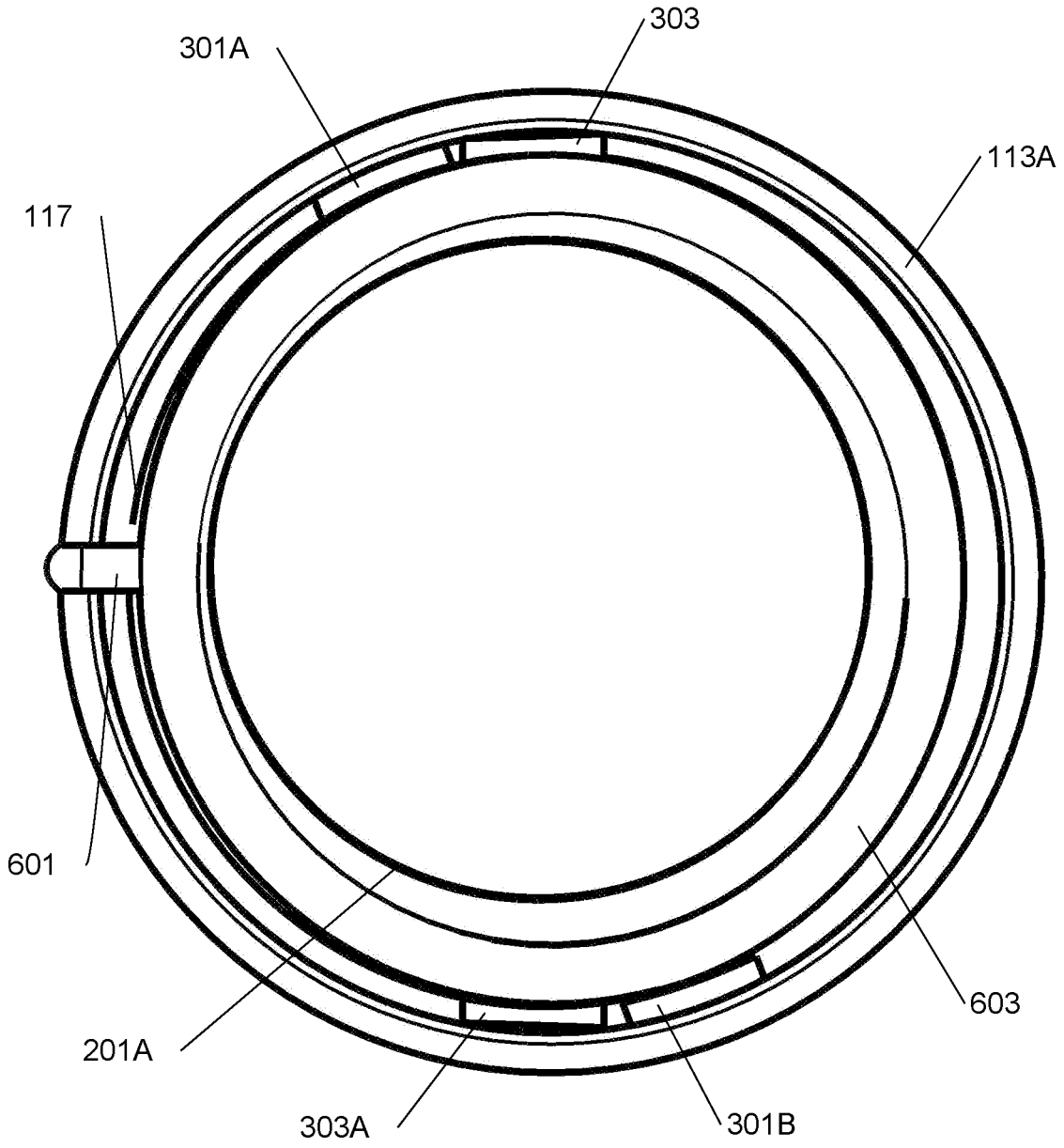

FIG. 9B. Shows a front view of FIG. 9A. To show a different angle of fixtures of locking cap in relation to ventral bar locking fixture.

Figure 9C:
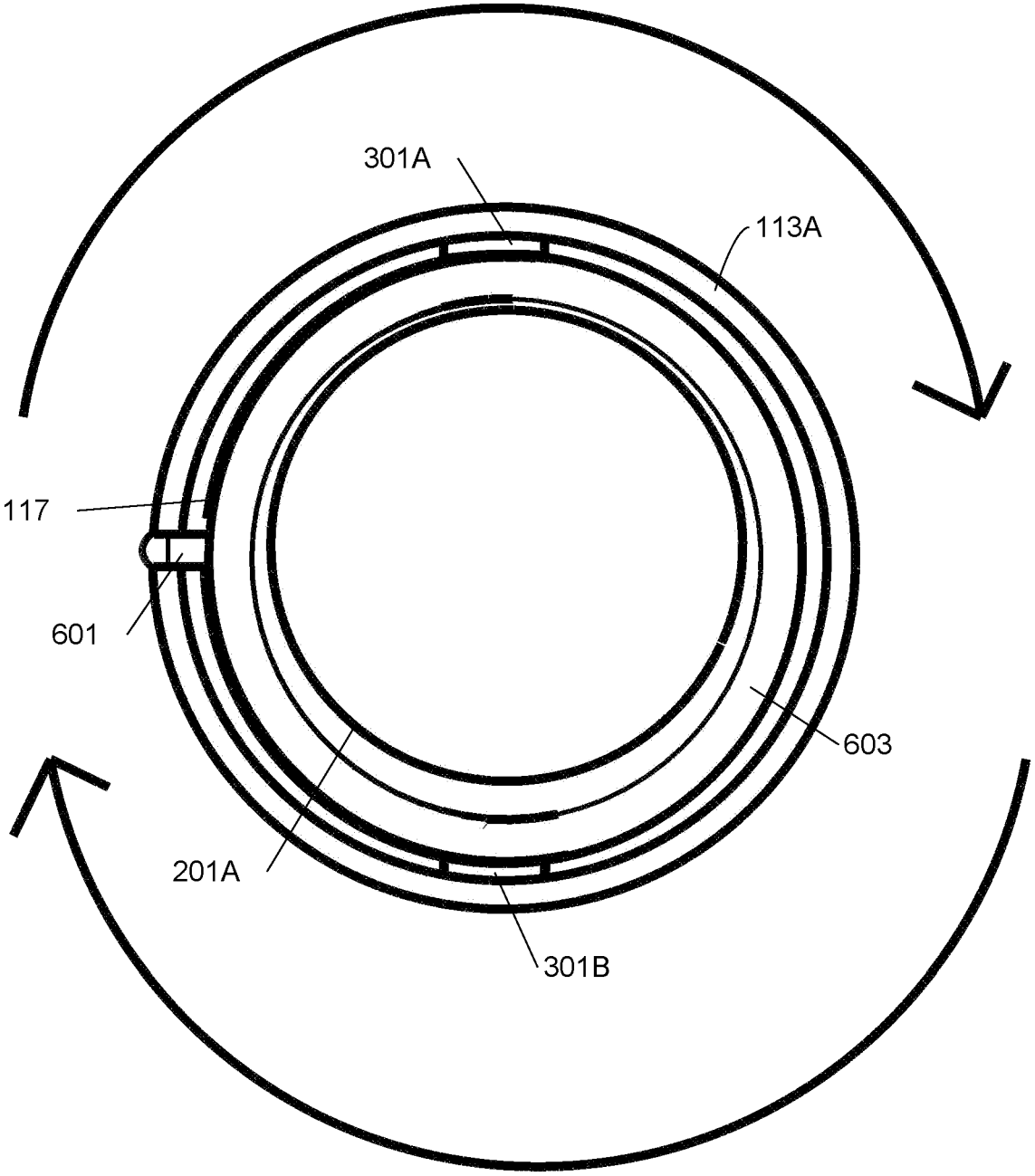

FIG. 9C. Shows a front view of locking cap locked into ventral bar.

Figure 10A:
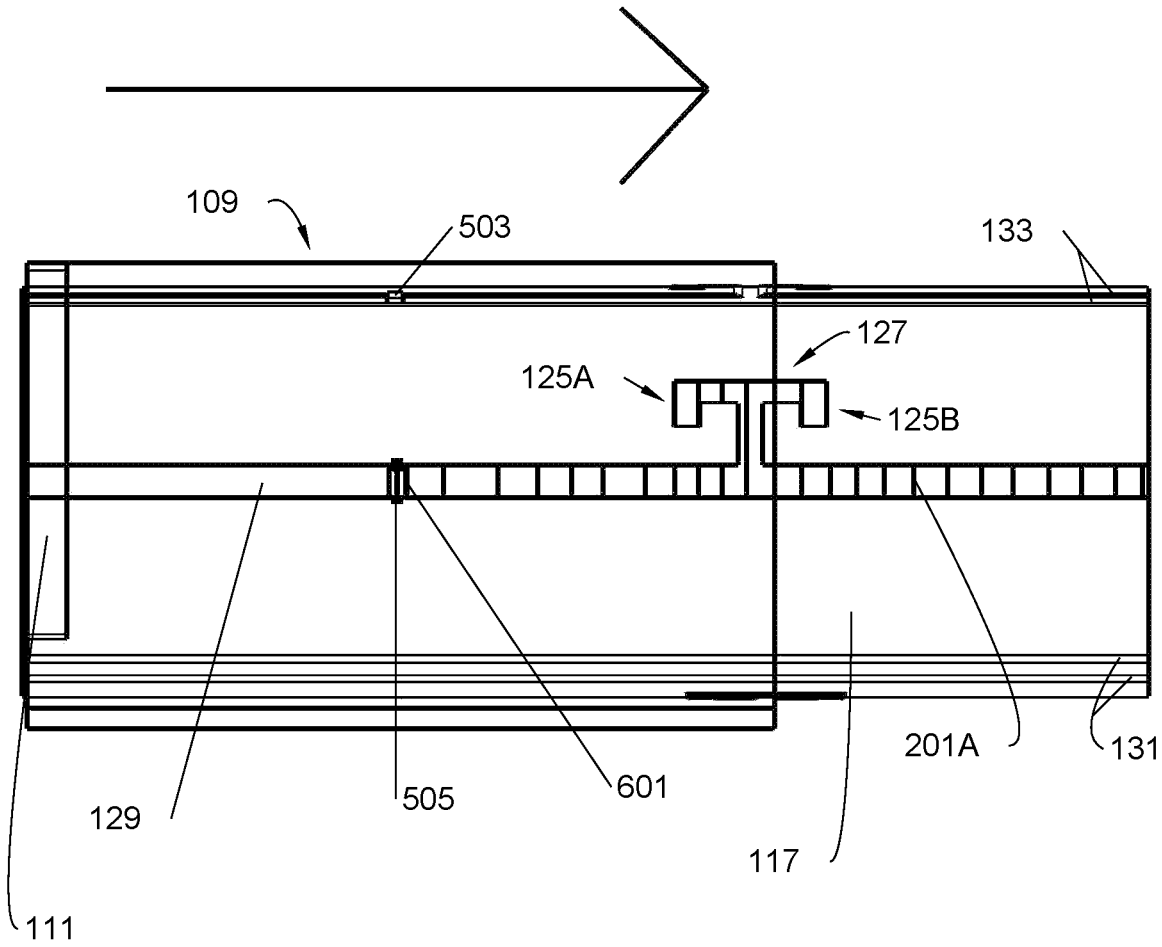

FIG. 10A. Shows a front view of a transparent handgrip compressing spring in medial pull-up position, with arrow indicating path.

Figure 10B:
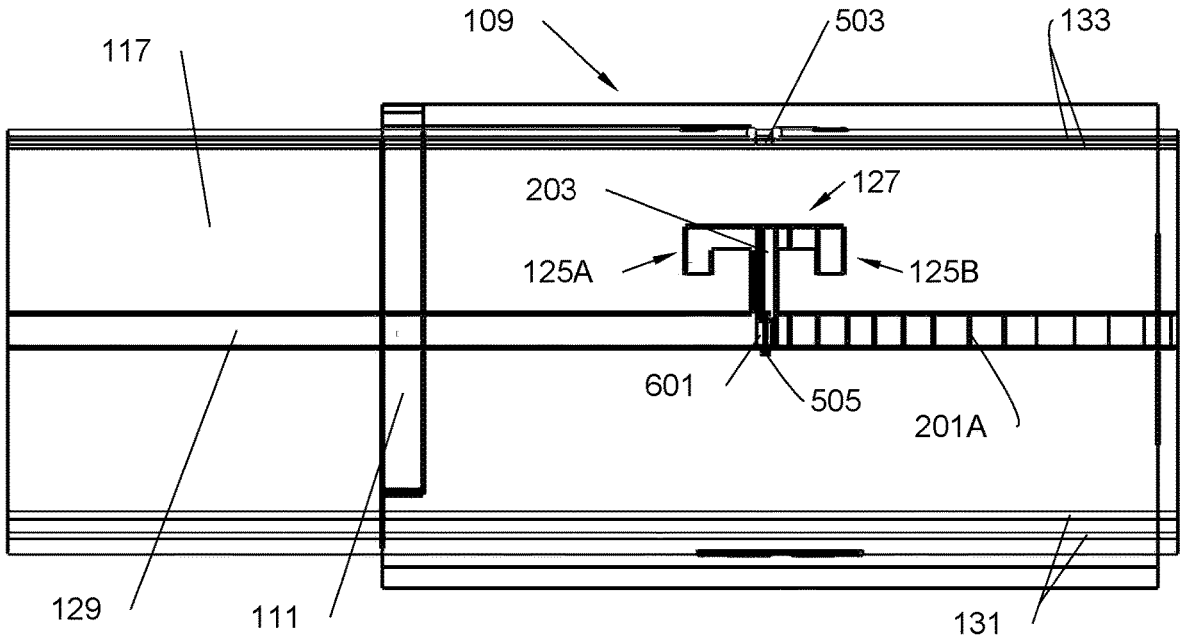

FIG. 10B. Shows a front view of a transparent handgrip with compression spring cap in the middle of "T" lock aperture.

Figure 10C:
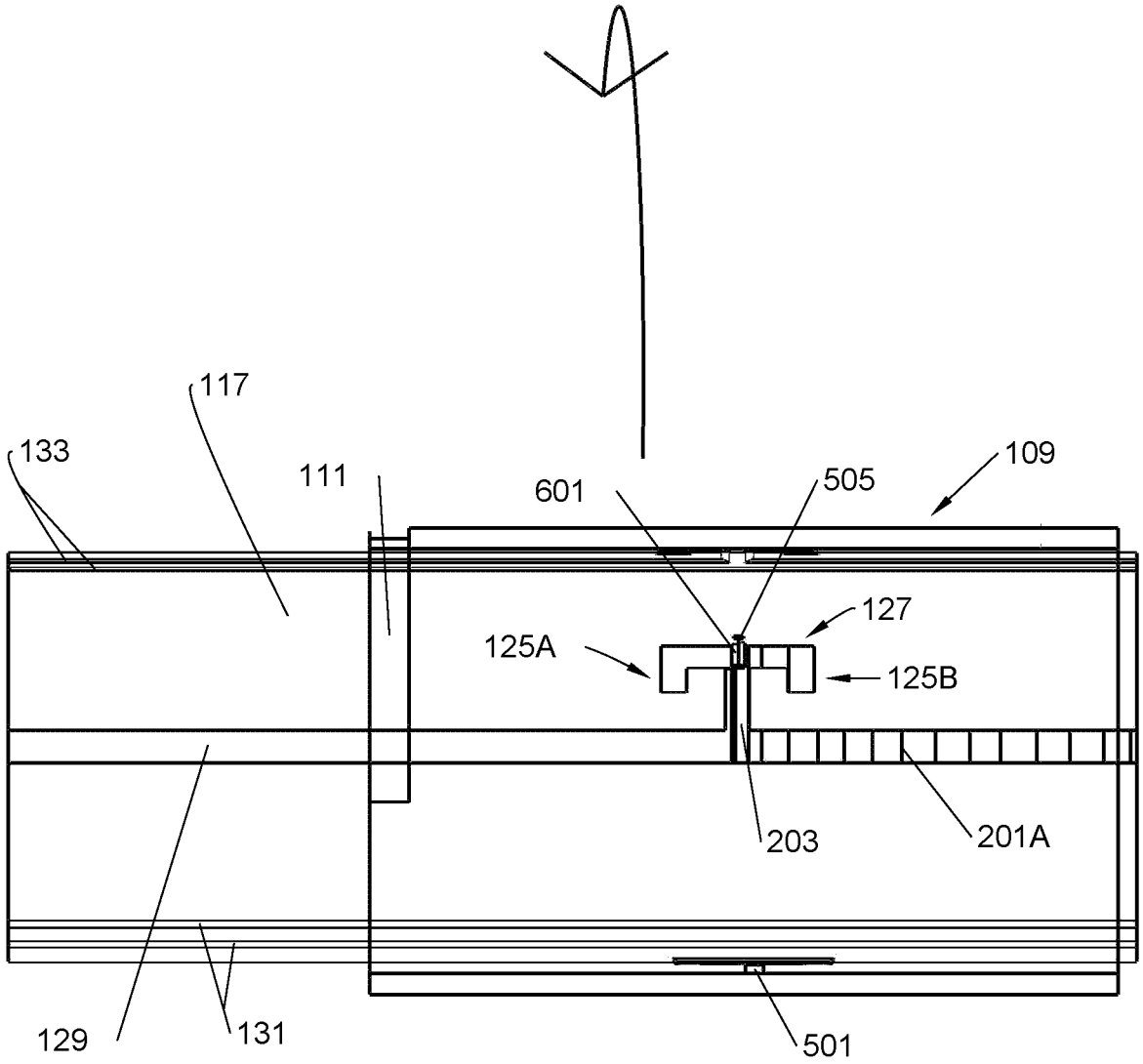

FIG. 10C. Shows a front view of a transparent handgrip rotated up into "T" lock aperture, with arrow indicating path of rotation.

Figure 10D:
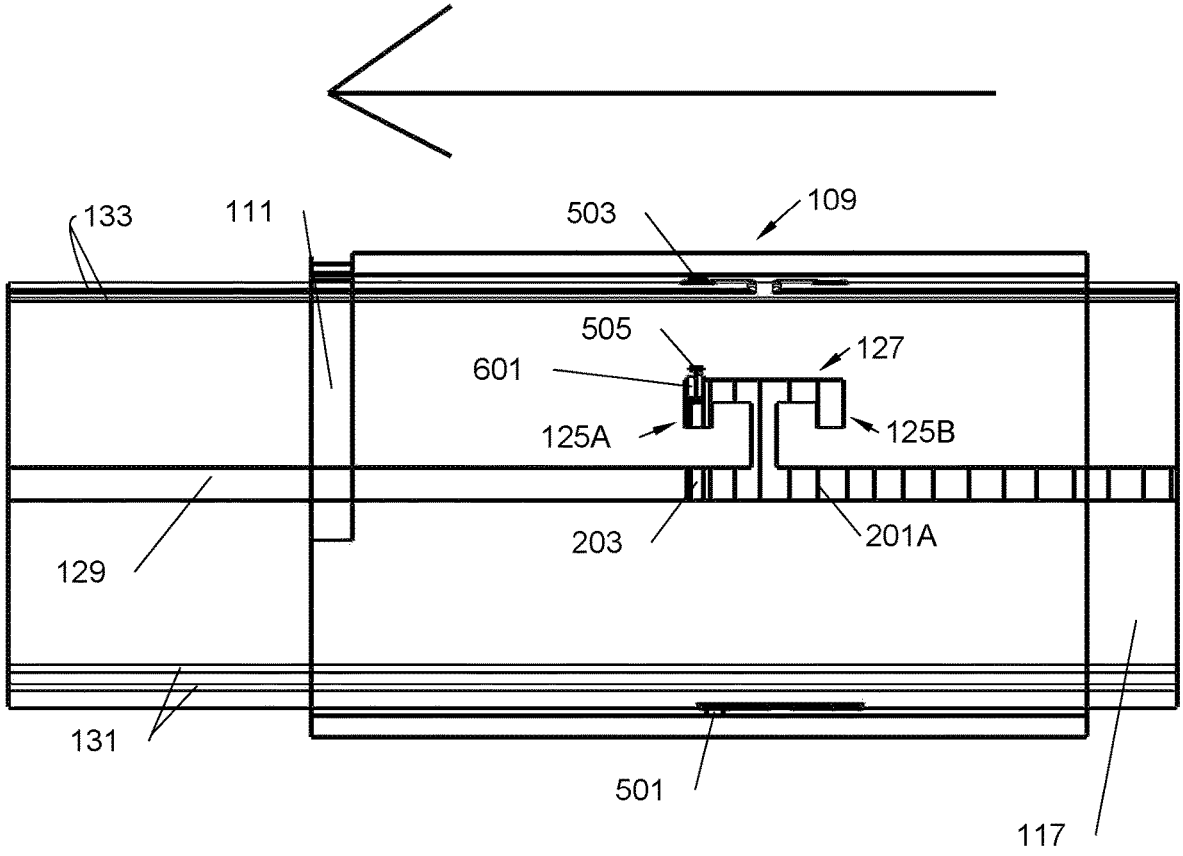

FIG. 10D. Shows a front view of a transparent handgrip moving laterally with spring decompressing, arrow indicating path.

Figure 10E:
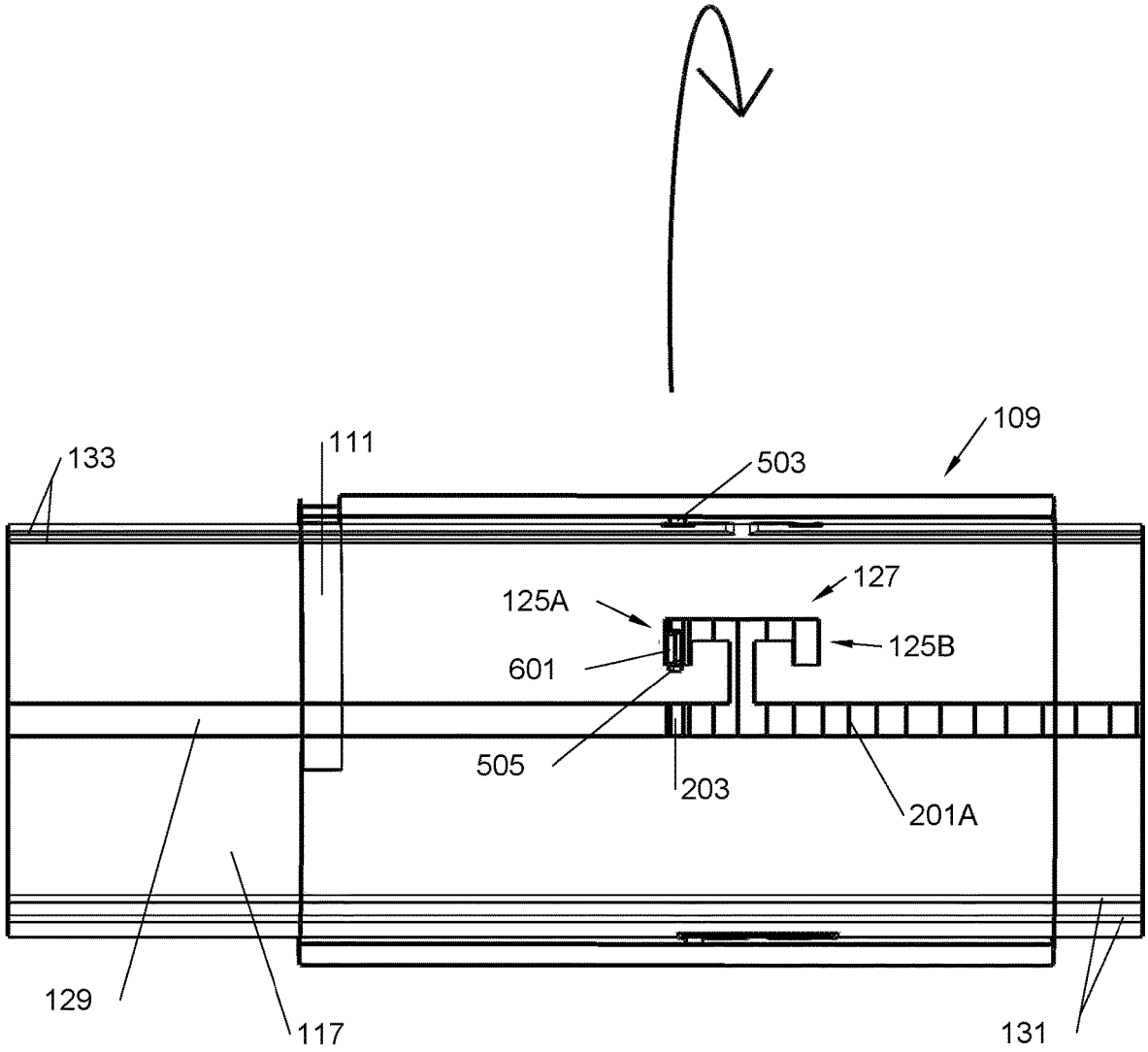

FIG. 10E. Shows a front view of a transparent handgrip rotated down and locked into medial arm of "T" lock aperture, with arrow indicating path of rotation.

Figure 11A:
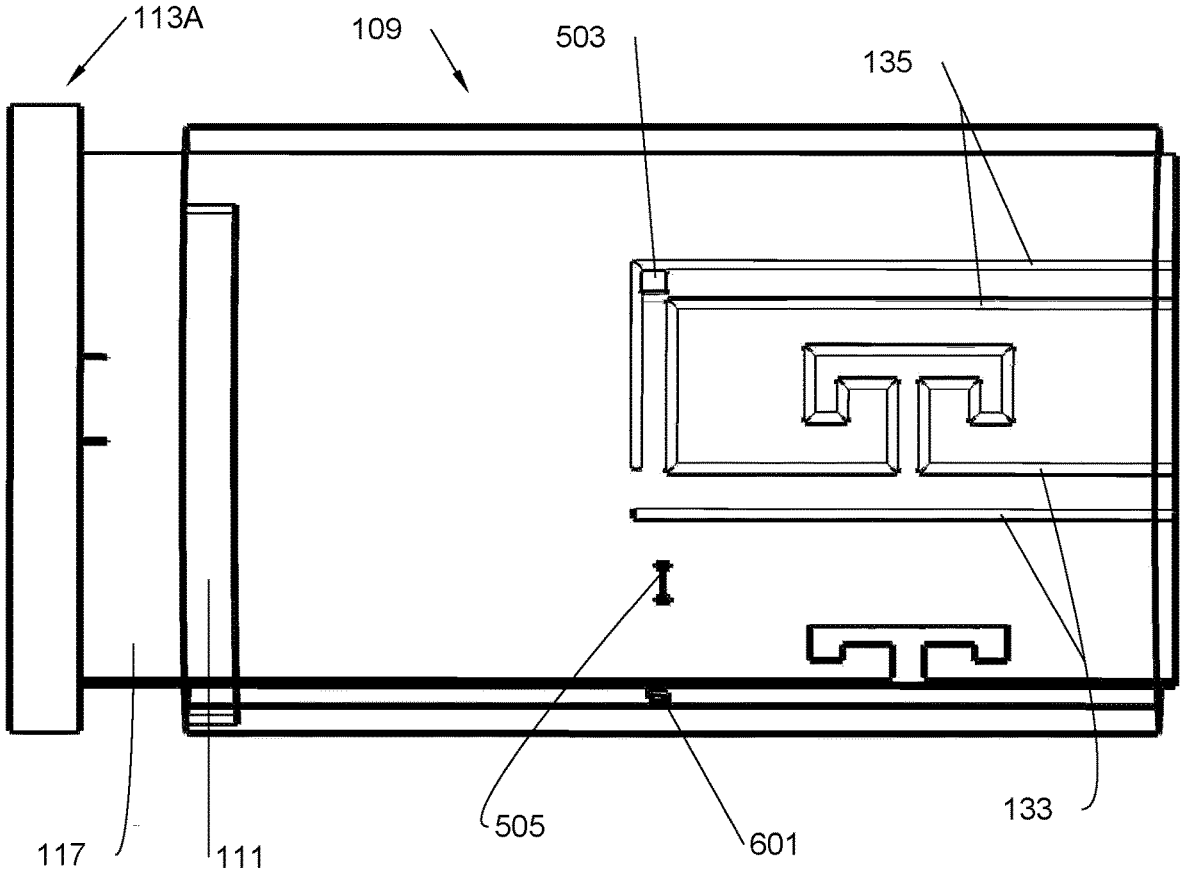

FIG. 11A. Shows a top view of ventral bar tracks with transparent handgrip at lateral end.

Figure 11B:
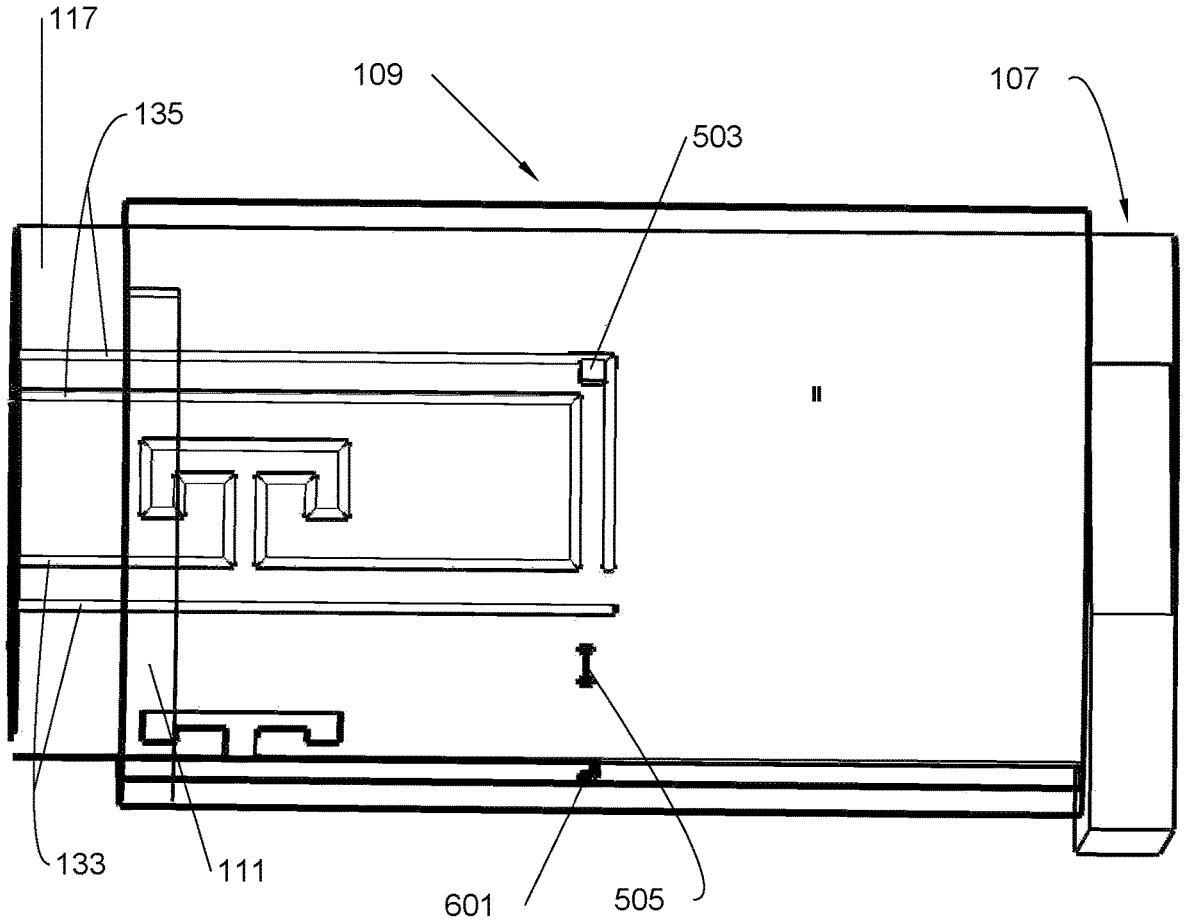

FIG. 11B. Shows a top view of ventral bar tracks with transparent handgrip at medial end.

Figure 12:
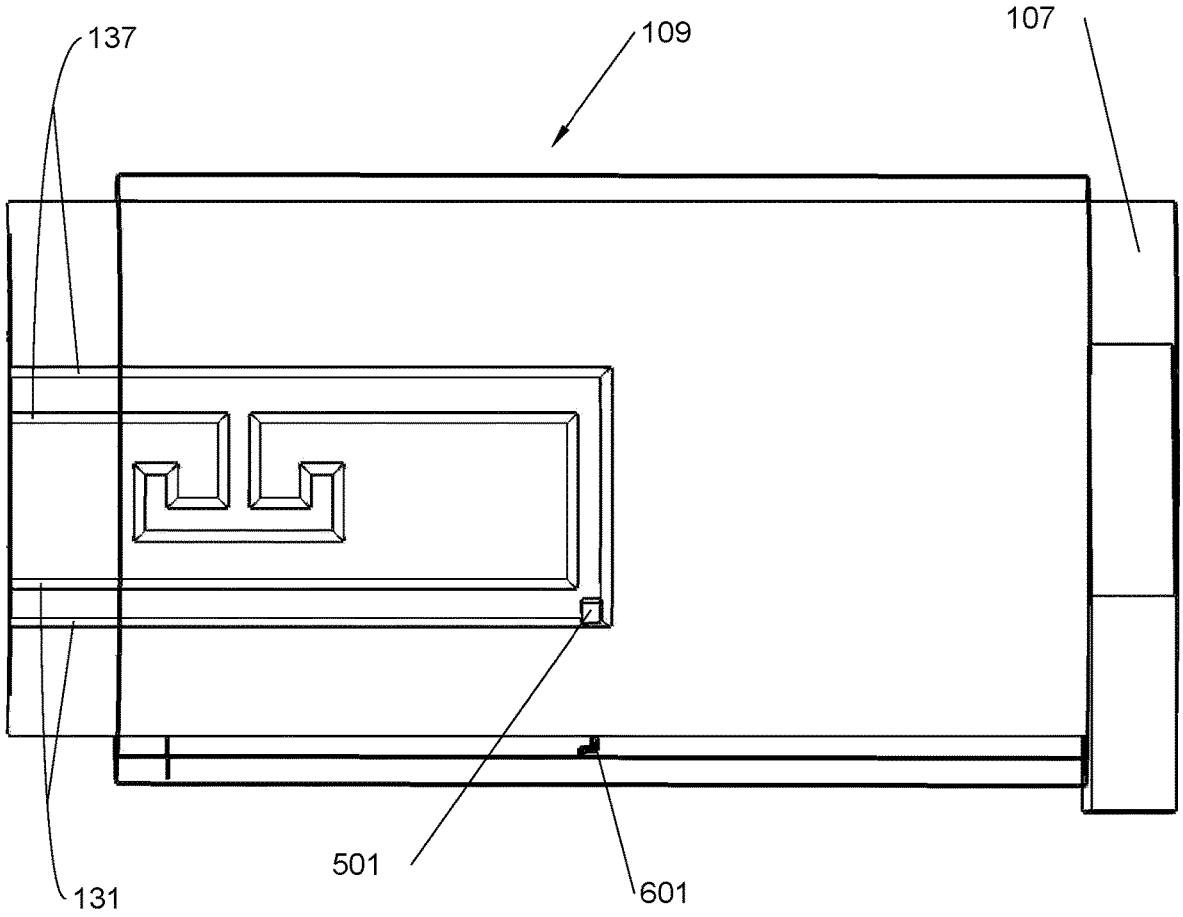

FIG. 12. Shows a bottom view of ventral bar tracks with transparent handgrip at medial end.

Figure 13:
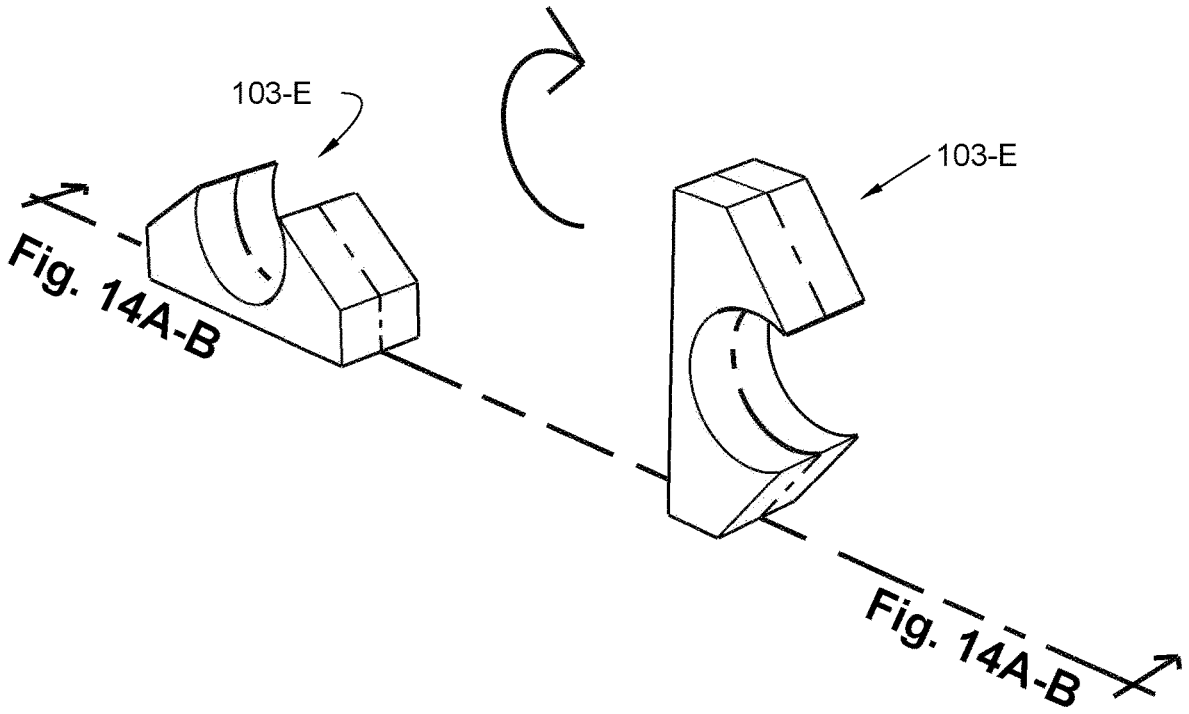

FIG. 13. Shows an iso right view sectional cut of rubber pegs, and direction of sight for upcoming figures, 14A-B.

Figure 14A:
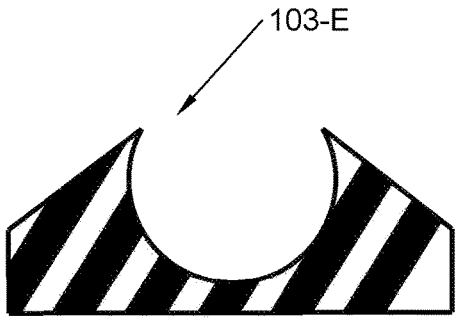

FIG. 14A. Shows a front view of rubber peg lying horizontally, with rubber hatching.

Figure 14B:
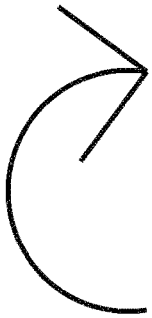
Figure 14B:
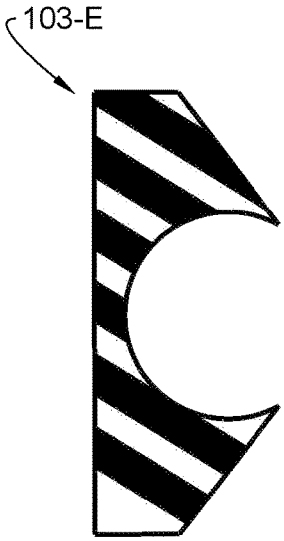

FIG. 14B. Shows a front view of rubber peg rotated to stand vertically, with rubber hatching.

Figure 15A:
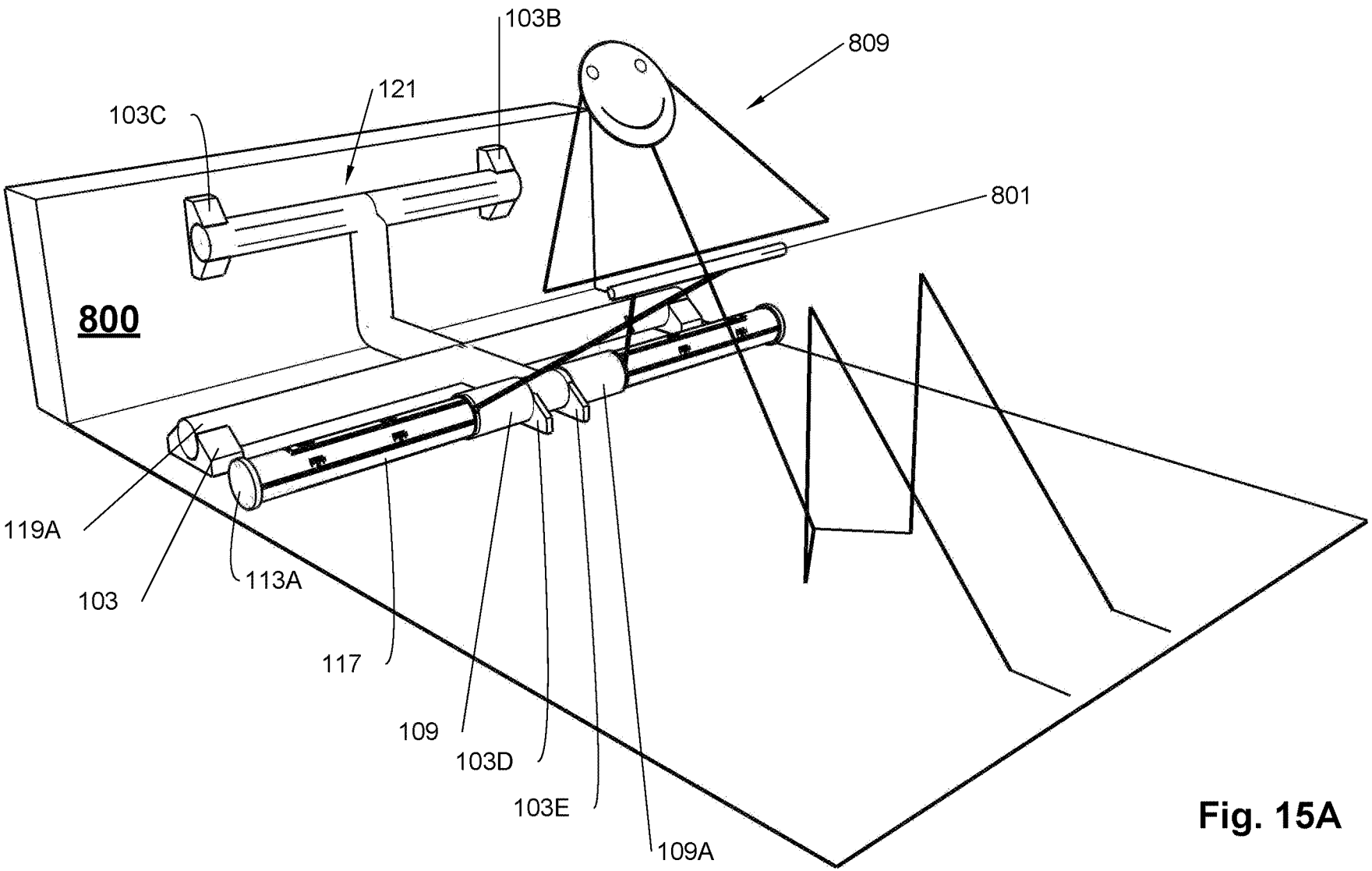

FIG. 15A. Shows a left iso view of fitness device in second setting, lower back extension/sit-up assistance, with person in starting position.

Figure 15B:
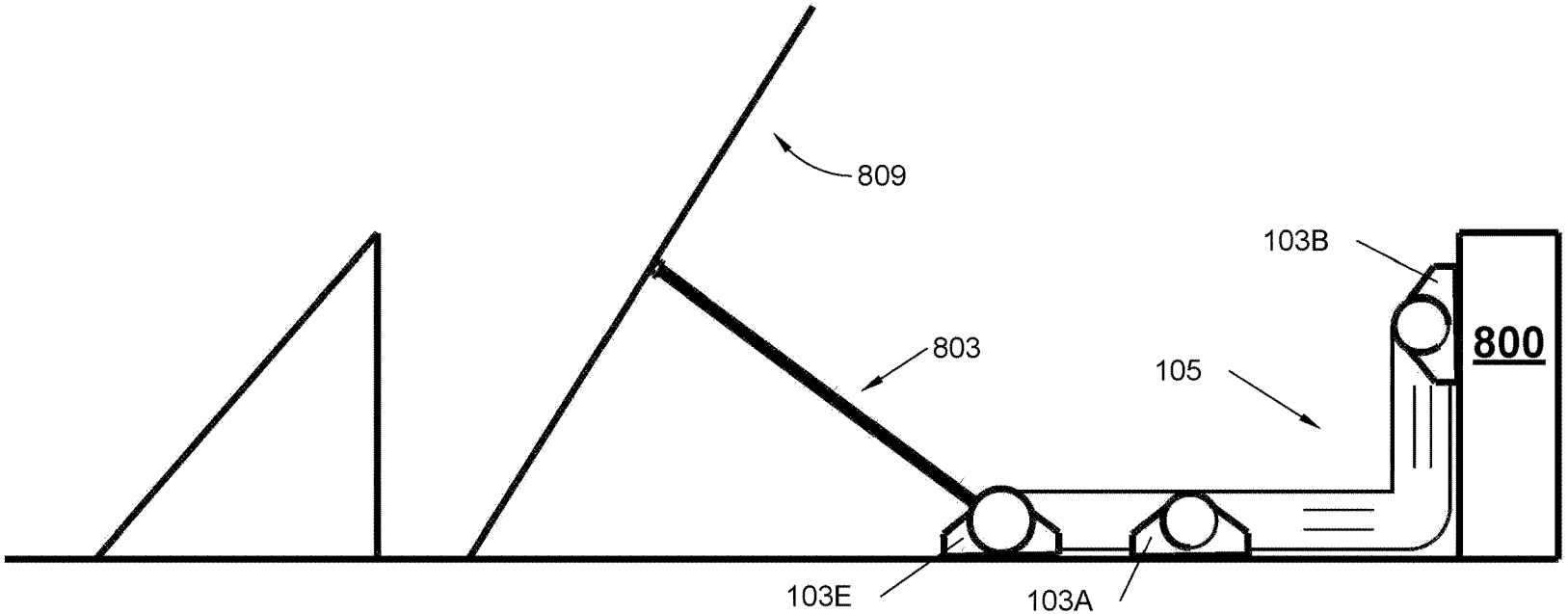

FIG. 15B. Shows a right side view of previous FIG. 15A in starting position.

Figure 15C:
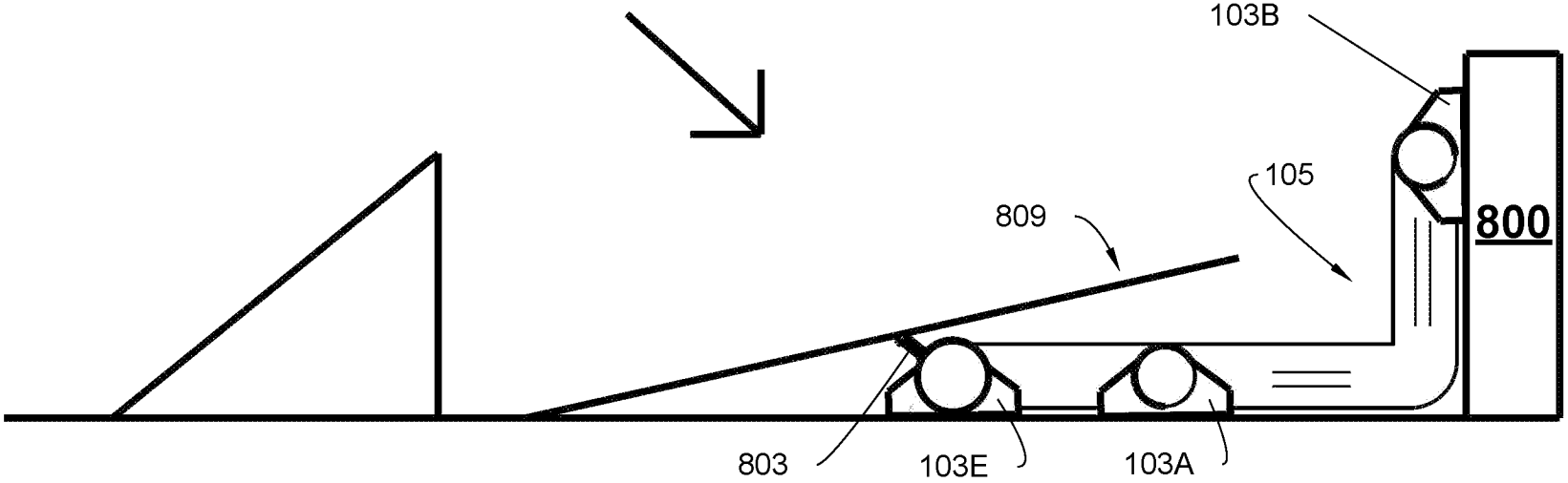

FIG. 15C. Shows a right side view of person engaging lower back extension/sit-up assistance device.

Figure 16:
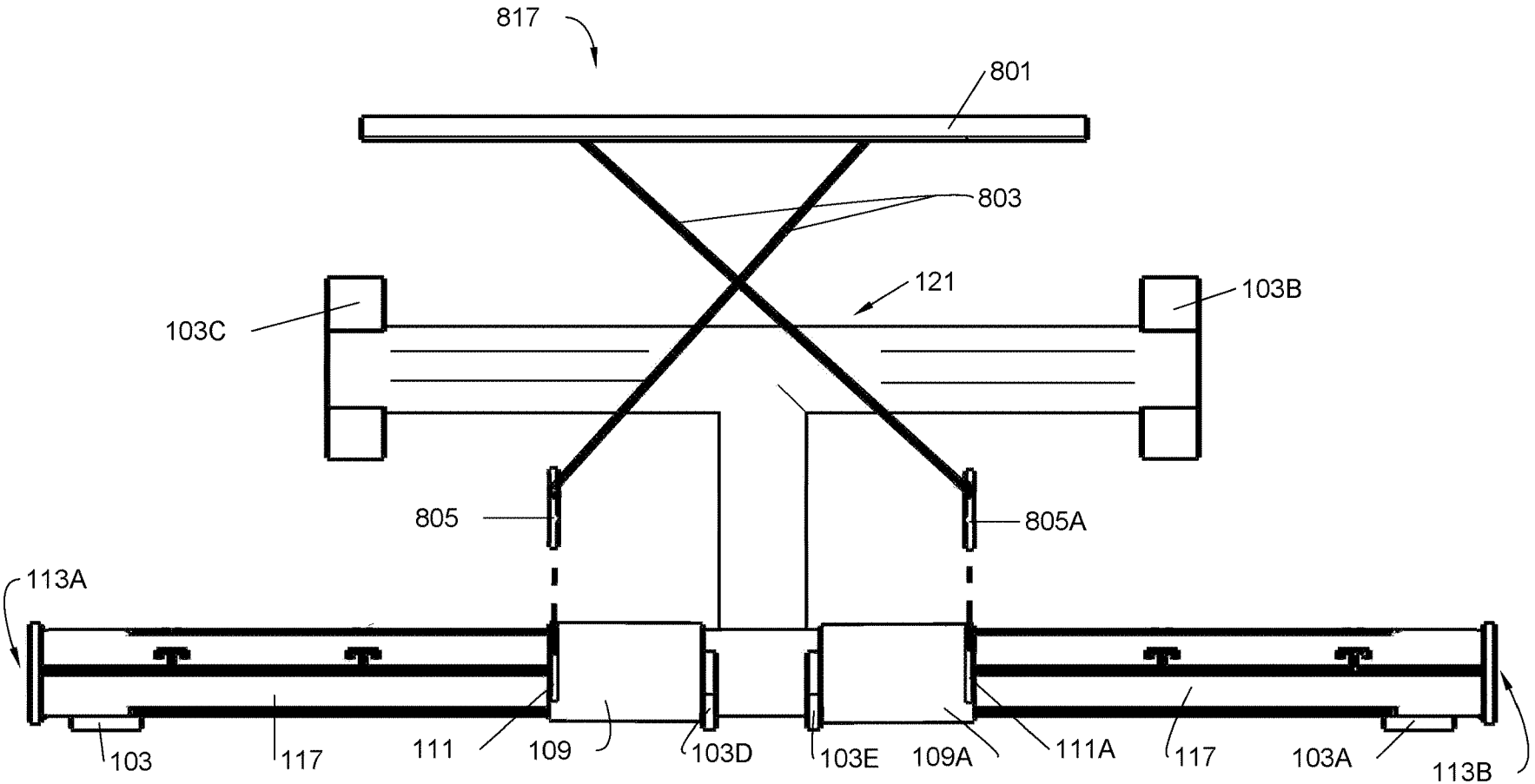

FIG. 16. Shows a front view of how lower back apparatus attaches to handgrips.

Figure 17:
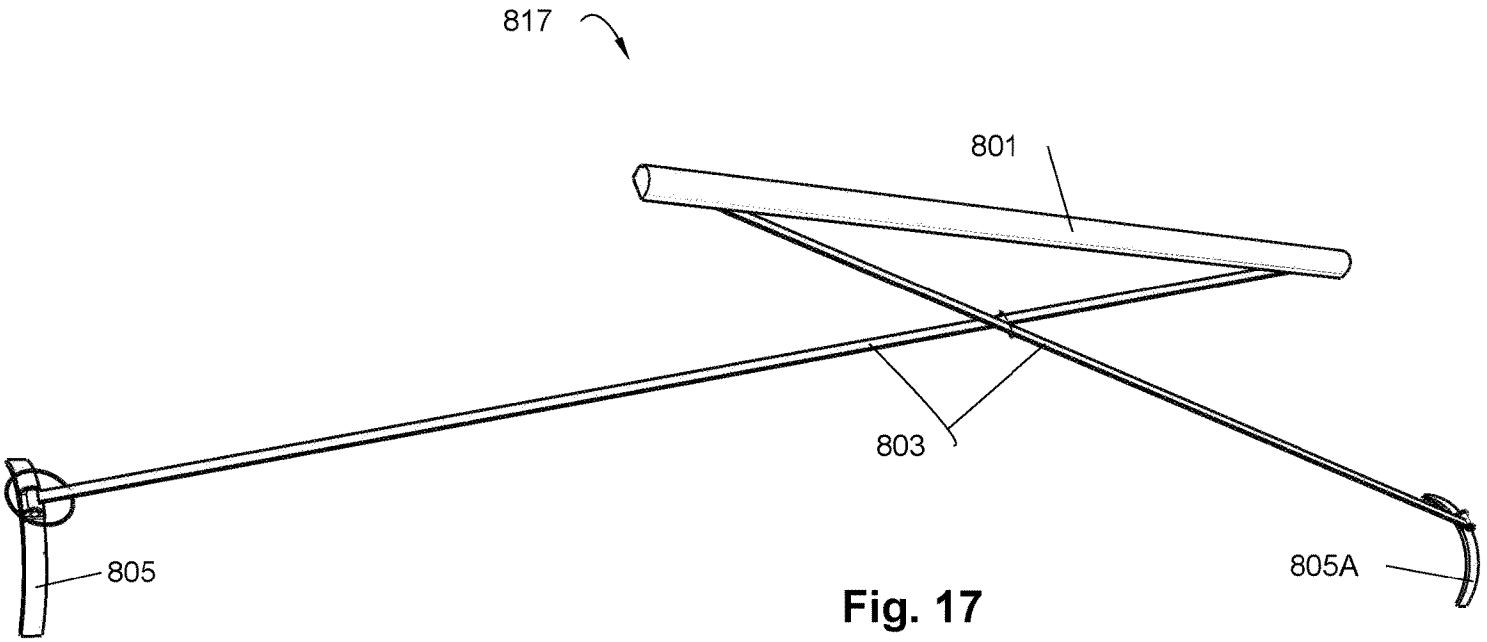

FIG. 17. Shows a left iso view perspective of lower back apparatus with hinge encircled.

Figure 18:
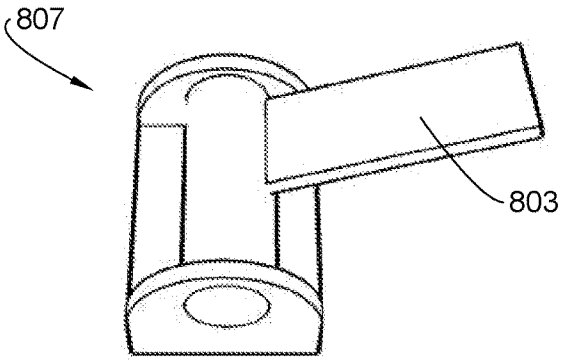

FIG. 18. Shows a front view perspective of encircled hinge close-up.

Figures 19, 20:
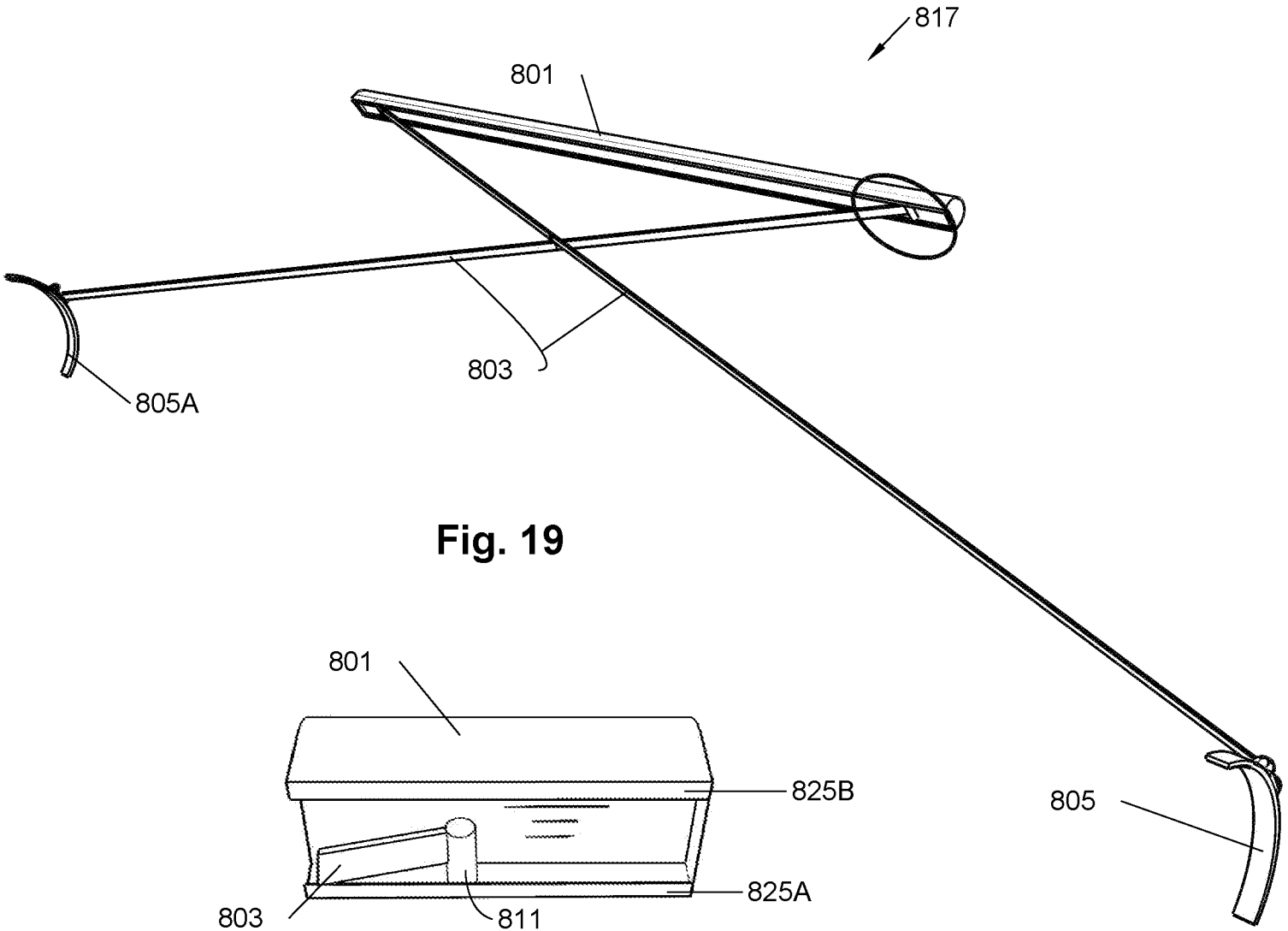

FIG. 19. Shows a back left iso view perspective of lower back apparatus, with the back of cushioned surface encircled.

FIG. 20. Shows a back view perspective of sliding mechanism for lower back apparatus close-up.

Figure 21:
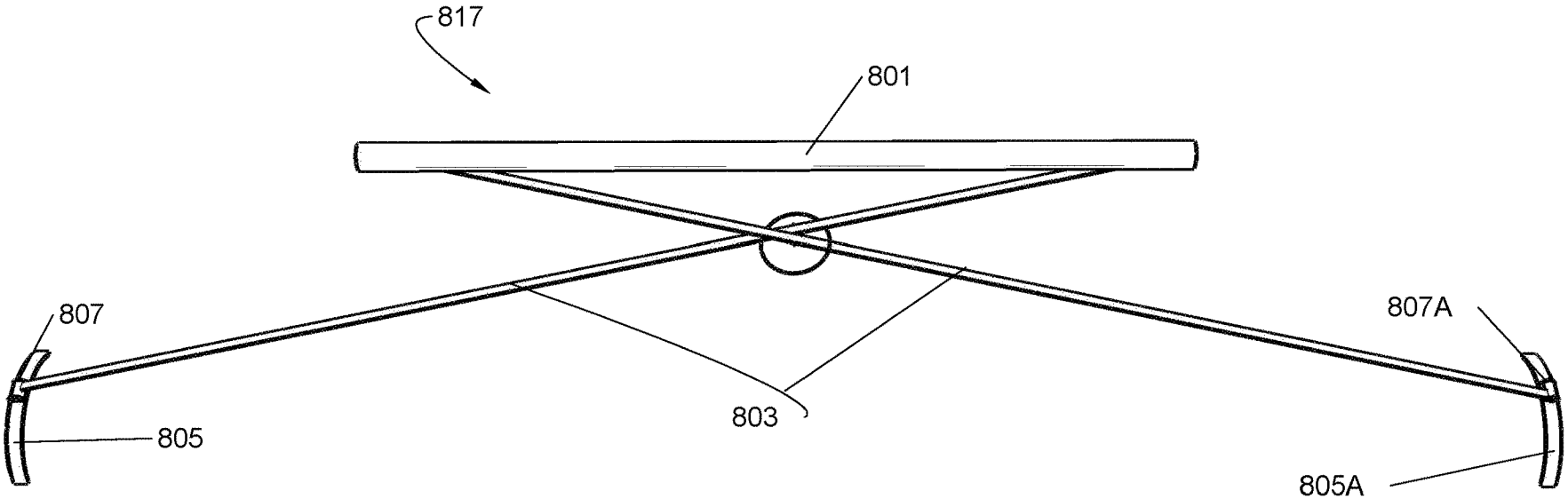

FIG. 21. Shows a front view perspective of lower back apparatus with pin connecting "X" bars encircled.

Figure 22:
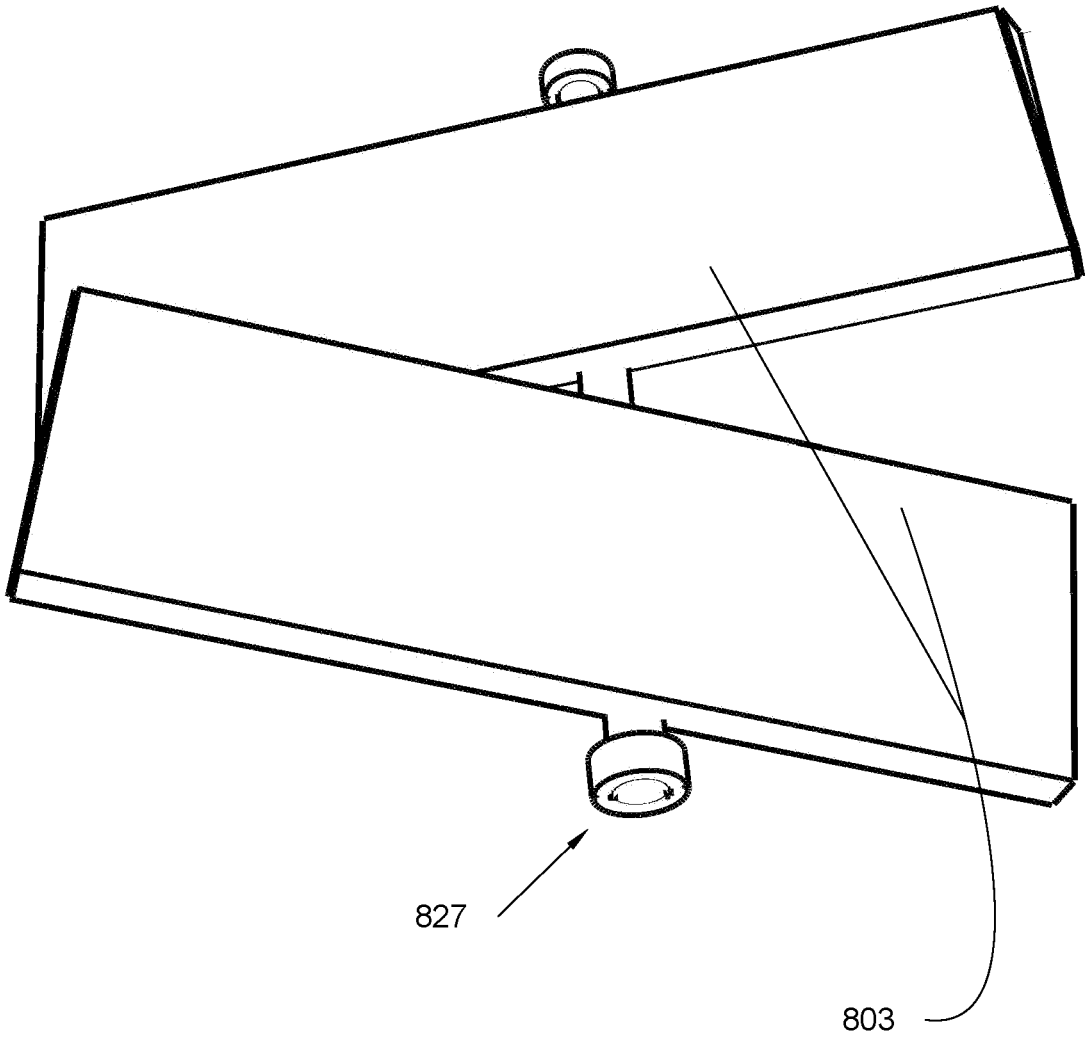

FIG. 22. Shows a front view perspective of "X" bar with pin connecting the two.

Figure 23:
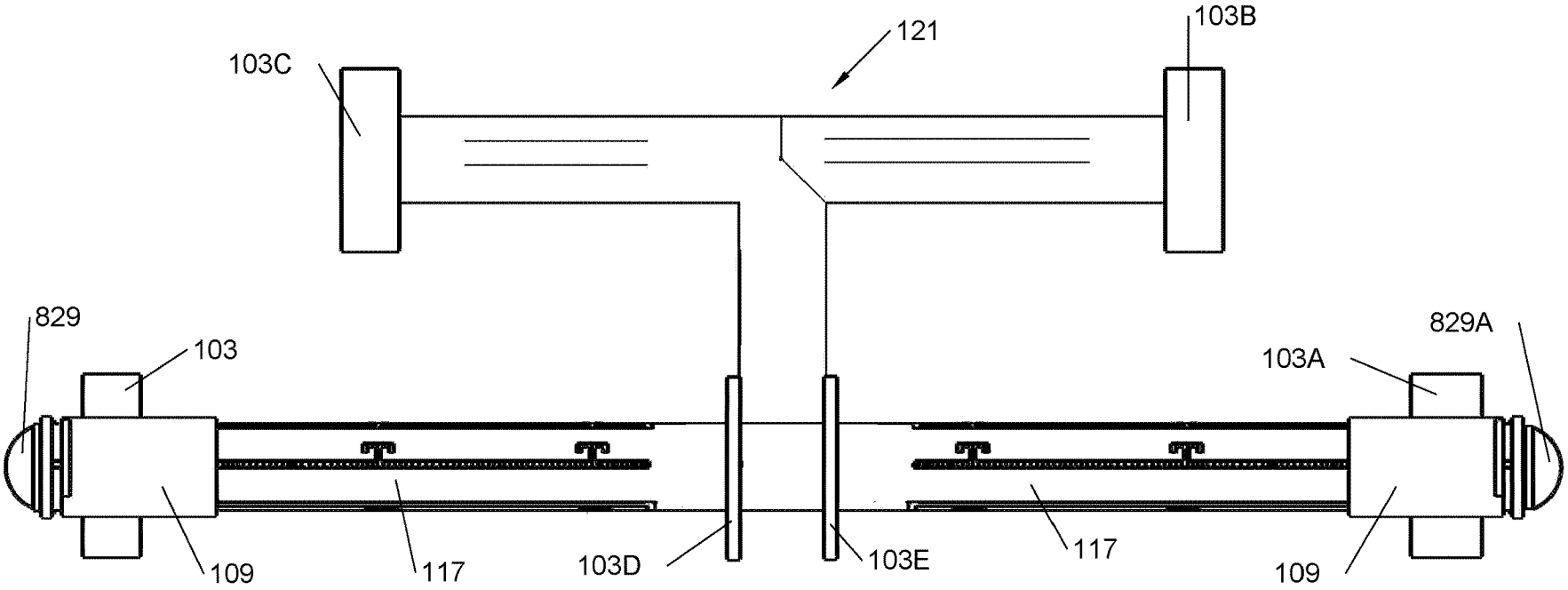

FIG. 23. Shows a front view of fitness device in second variation, with knobs on lateral ends of device.

Figure 24:
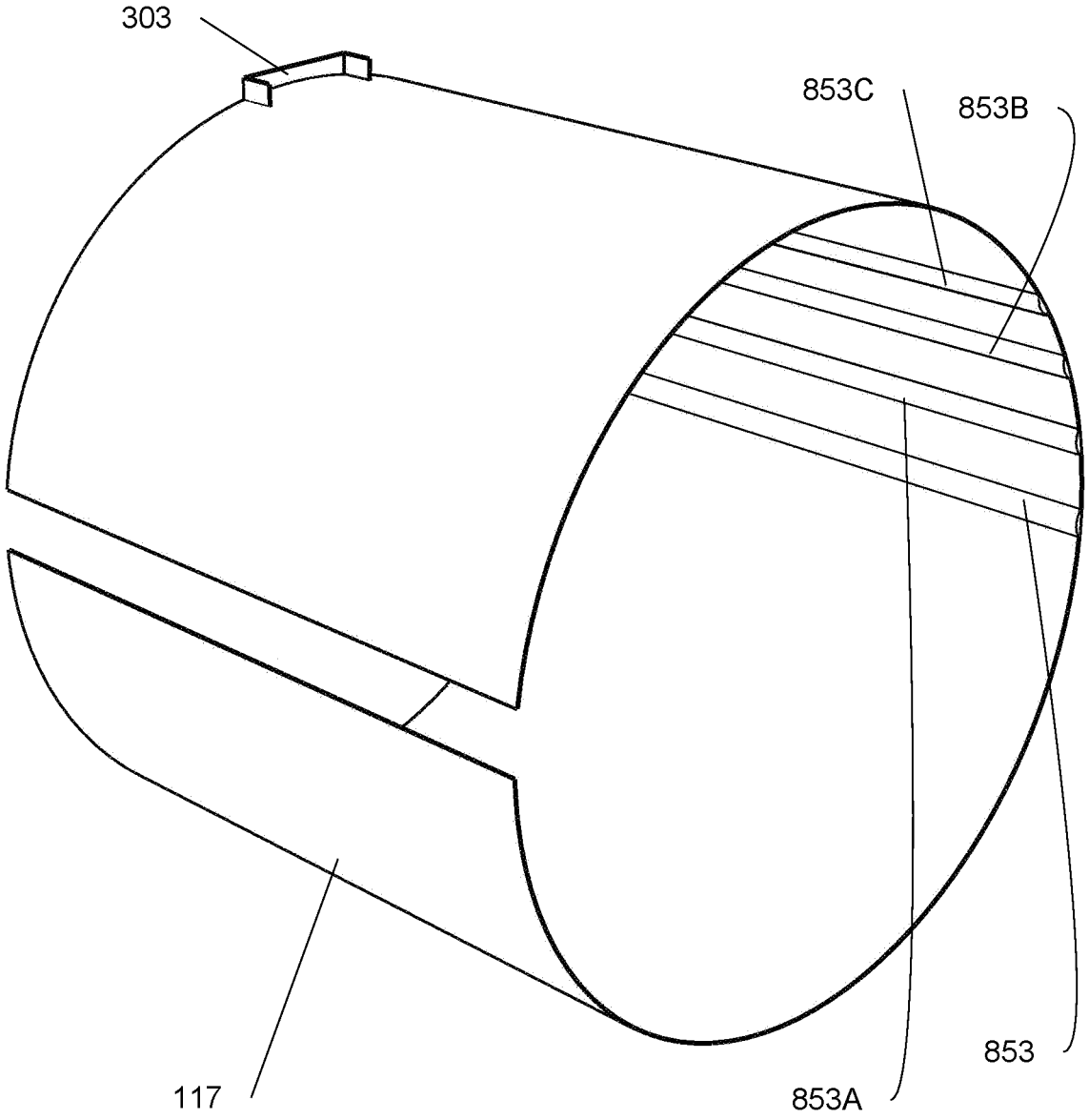

FIG. 24. Shows an iso right perspective view of tracks inside cavity of ventral bar in second variation.

Figure 25:
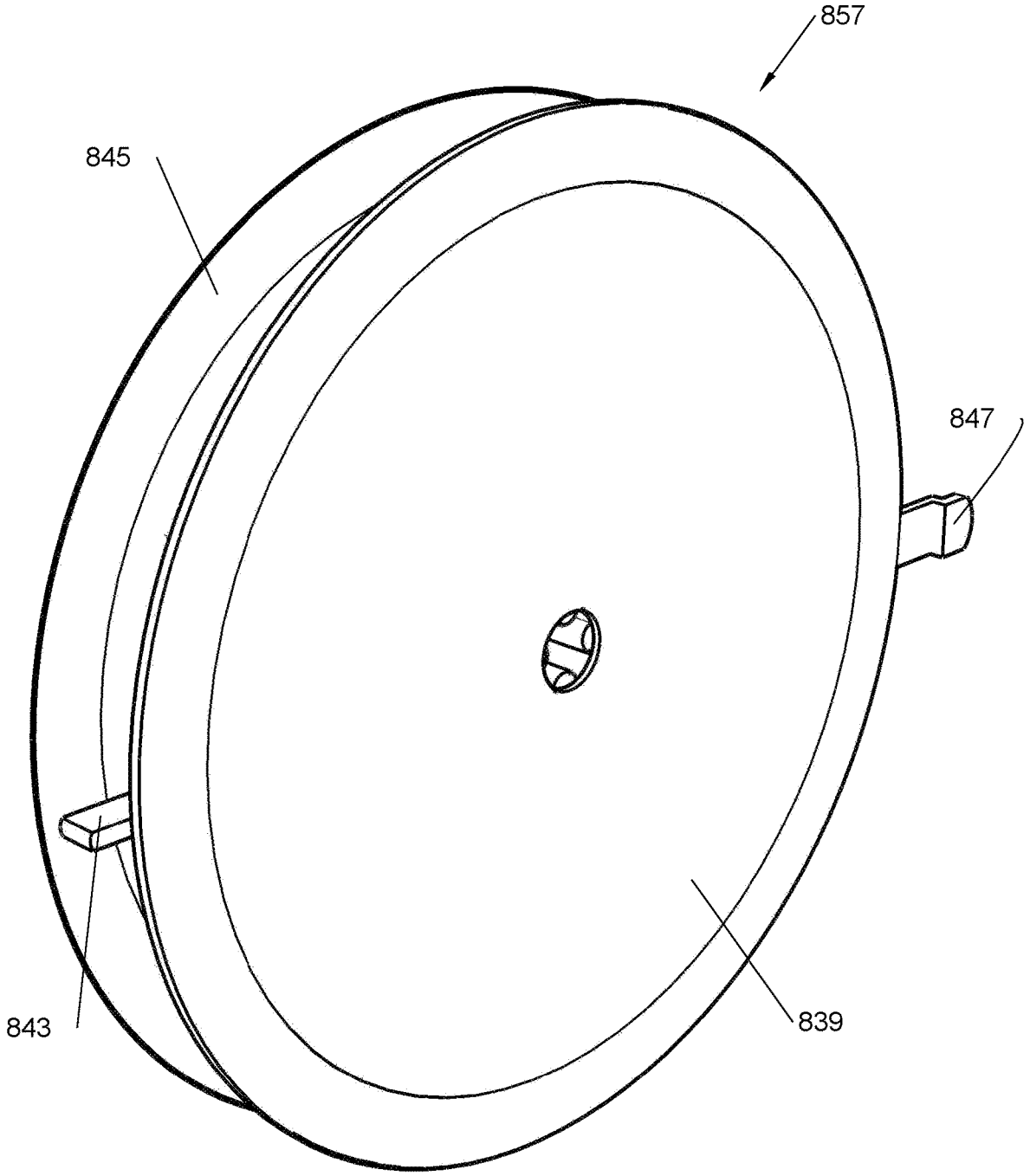

FIG. 25. Shows an iso back perspective view of inclusive component (857)

Figure 26:
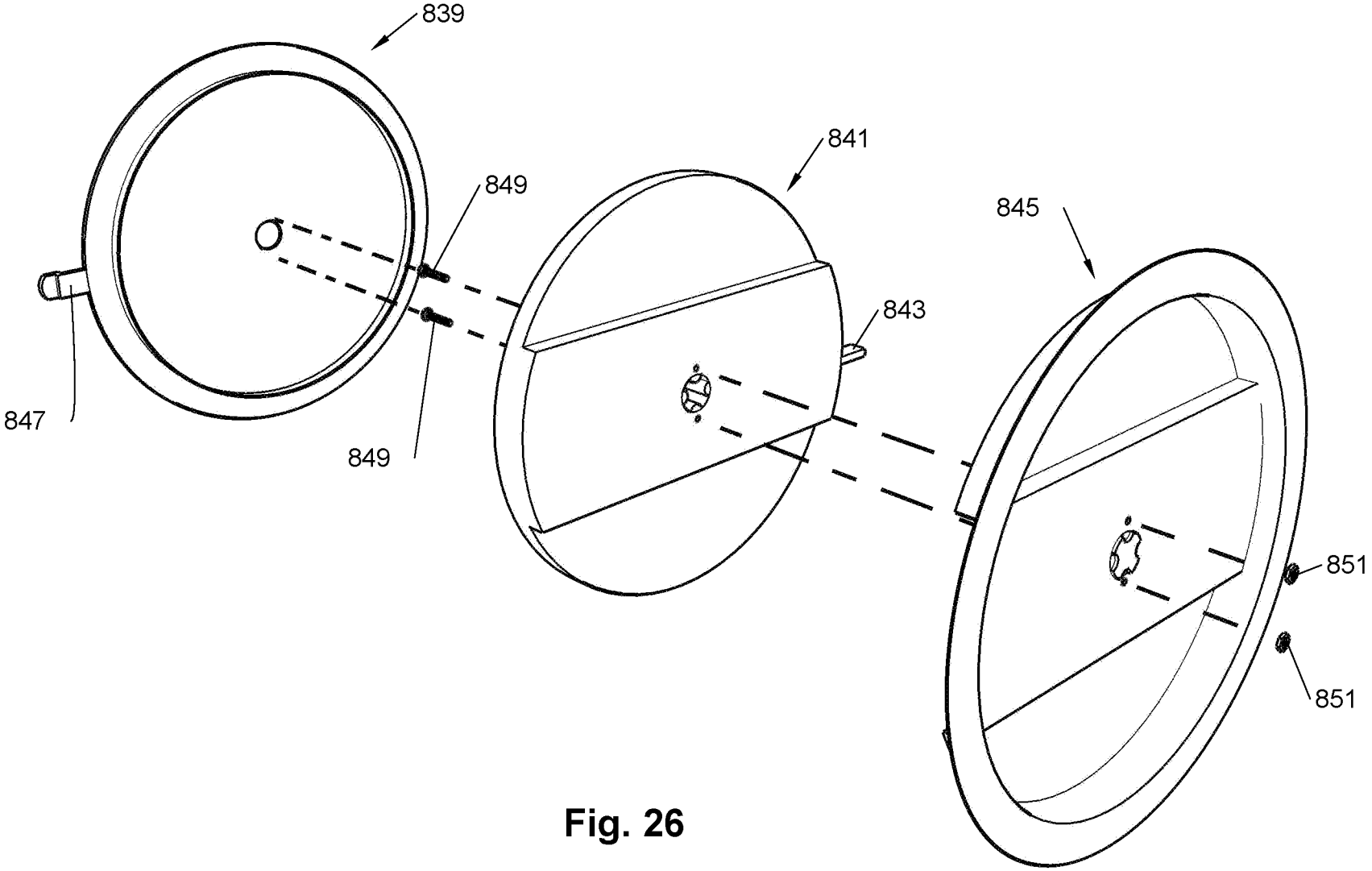

FIG. 26. Shows an iso right perspective view of inclusive component (857) exploded.

Figure 27:
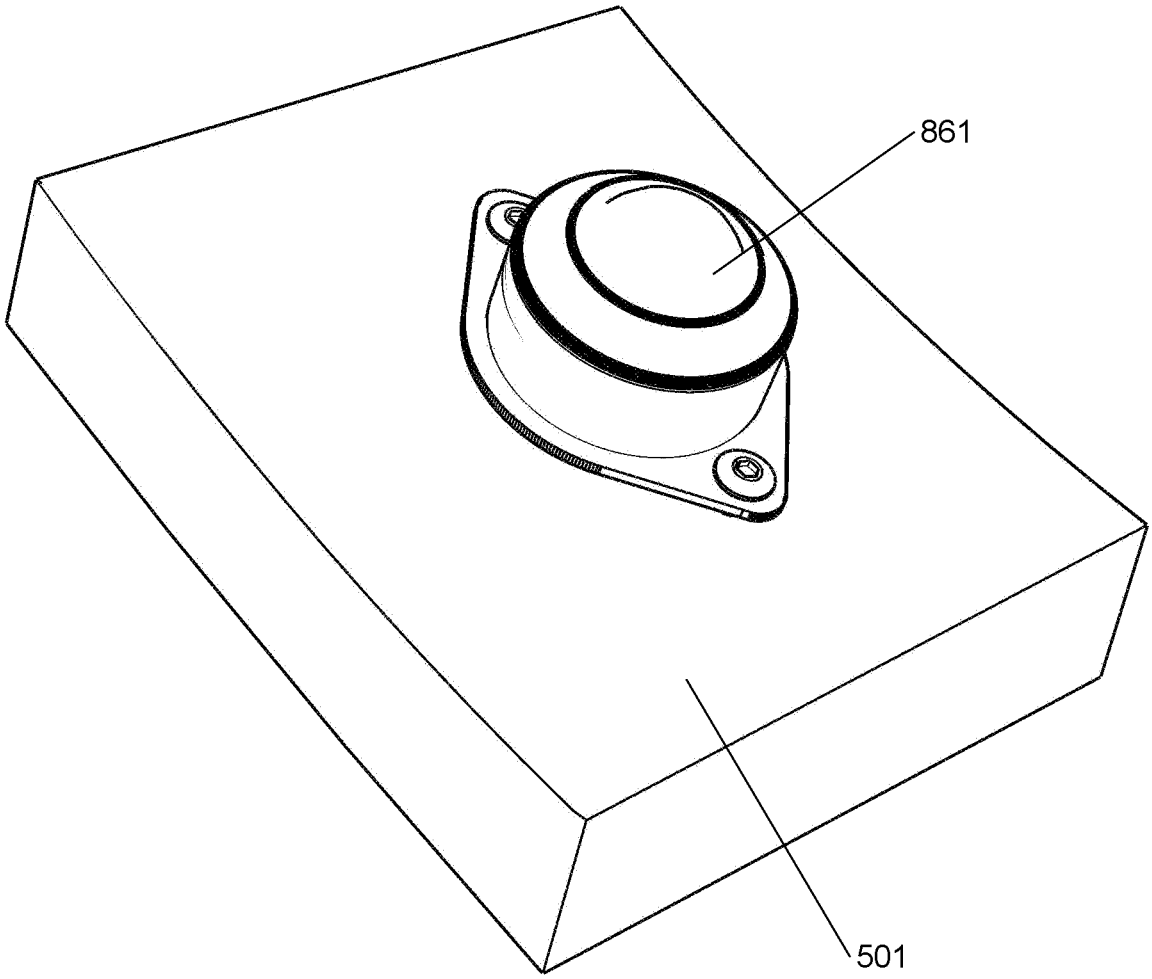

FIG. 27. Shows an iso close-up perspective of fitness device in another claimed embodiment having ball-bearings on handgrips projection in order to slide.

Figure 28A:
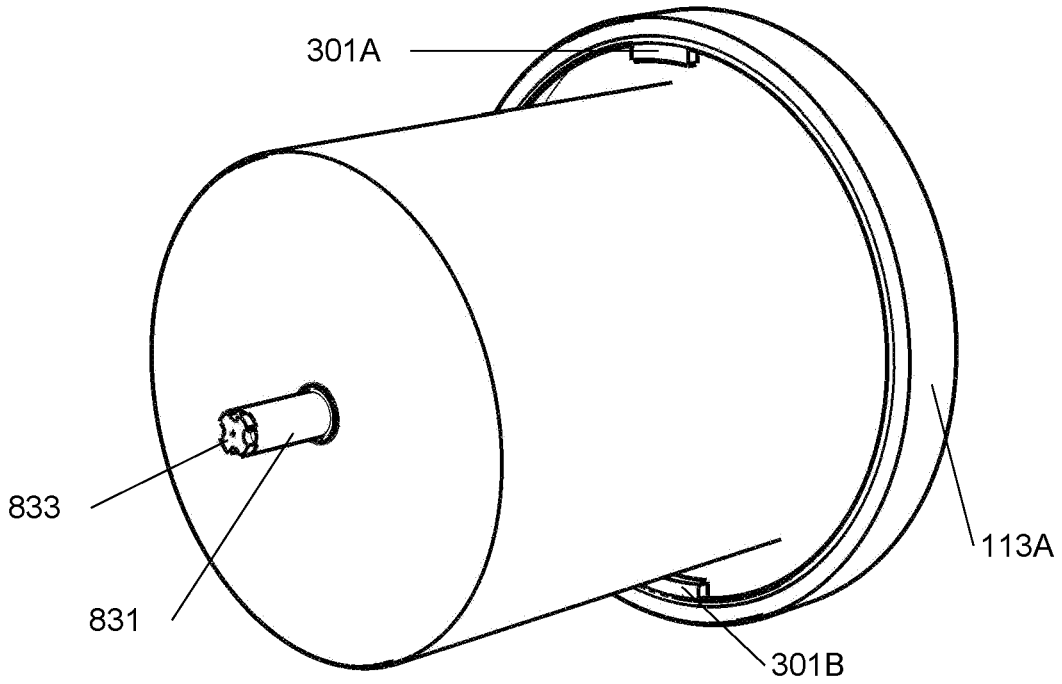

FIG. 28A. Shows an iso back view perspective of locking cap/knob.

Figure 28B:
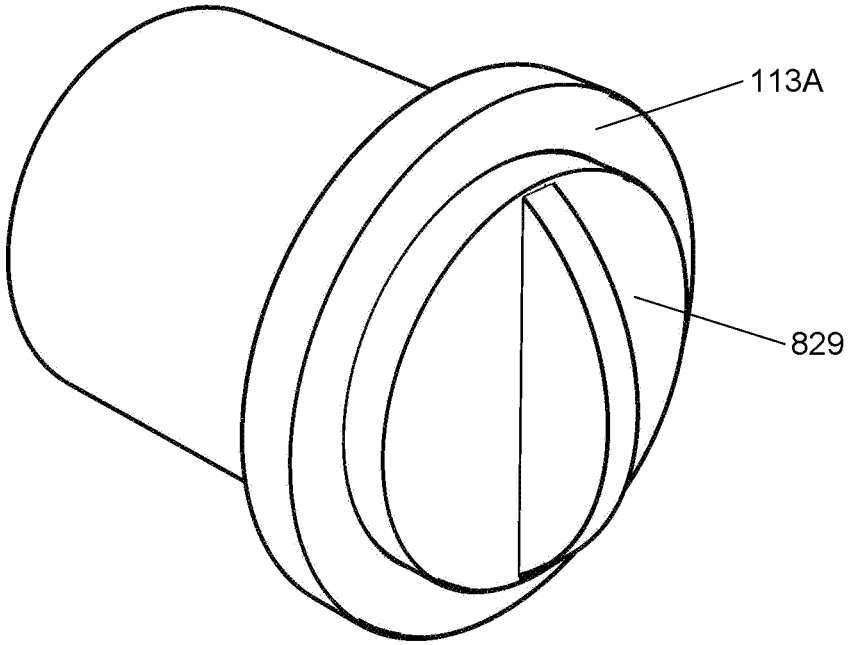

FIG. 28B. Shows an iso front view perspective of locking cap/knob.

Figure 29:
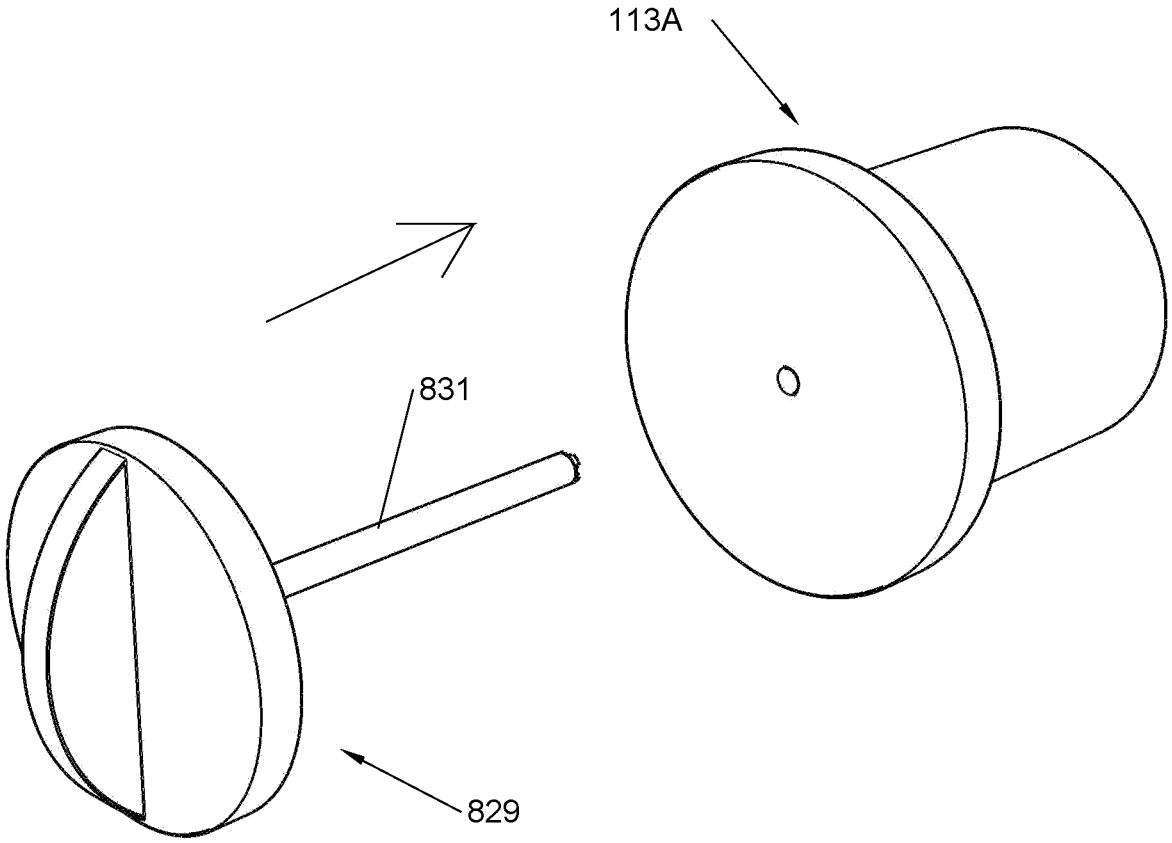

FIG. 29. Shows an iso front view perspective of knob being inserted into locking cap.

Figure 30:
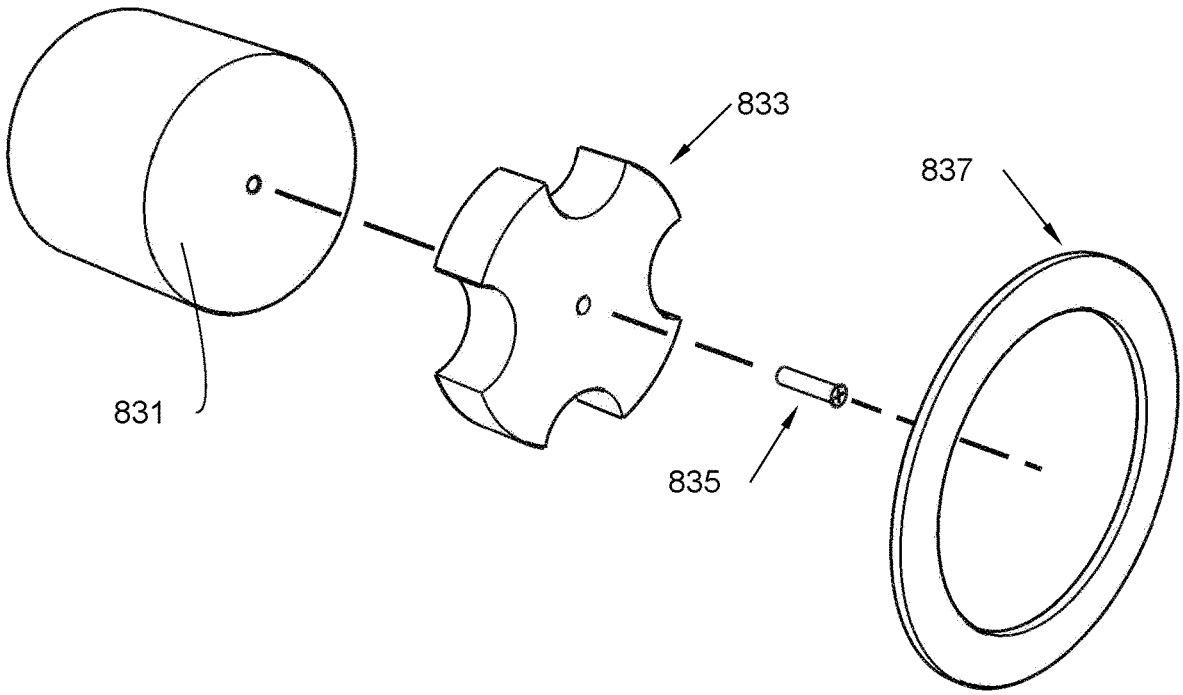

FIG. 30. Shows an iso front view perspective of exploded key on cylindrical protuberance of knob.

Figure 31:
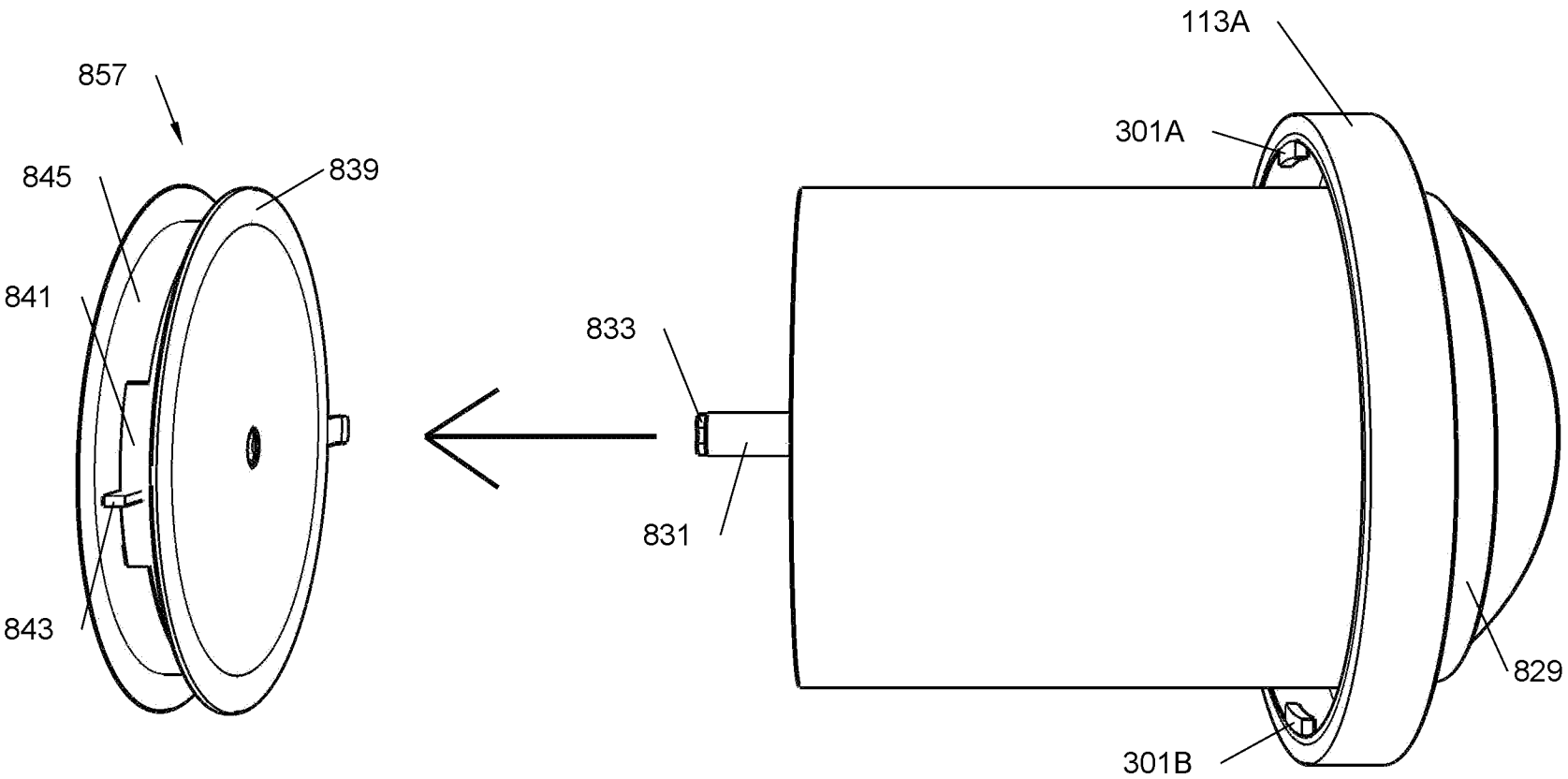

FIG. 31. Shows a left perspective view of how key from knob will be inserted into keyhole of inclusive component (857).

Figure 32:
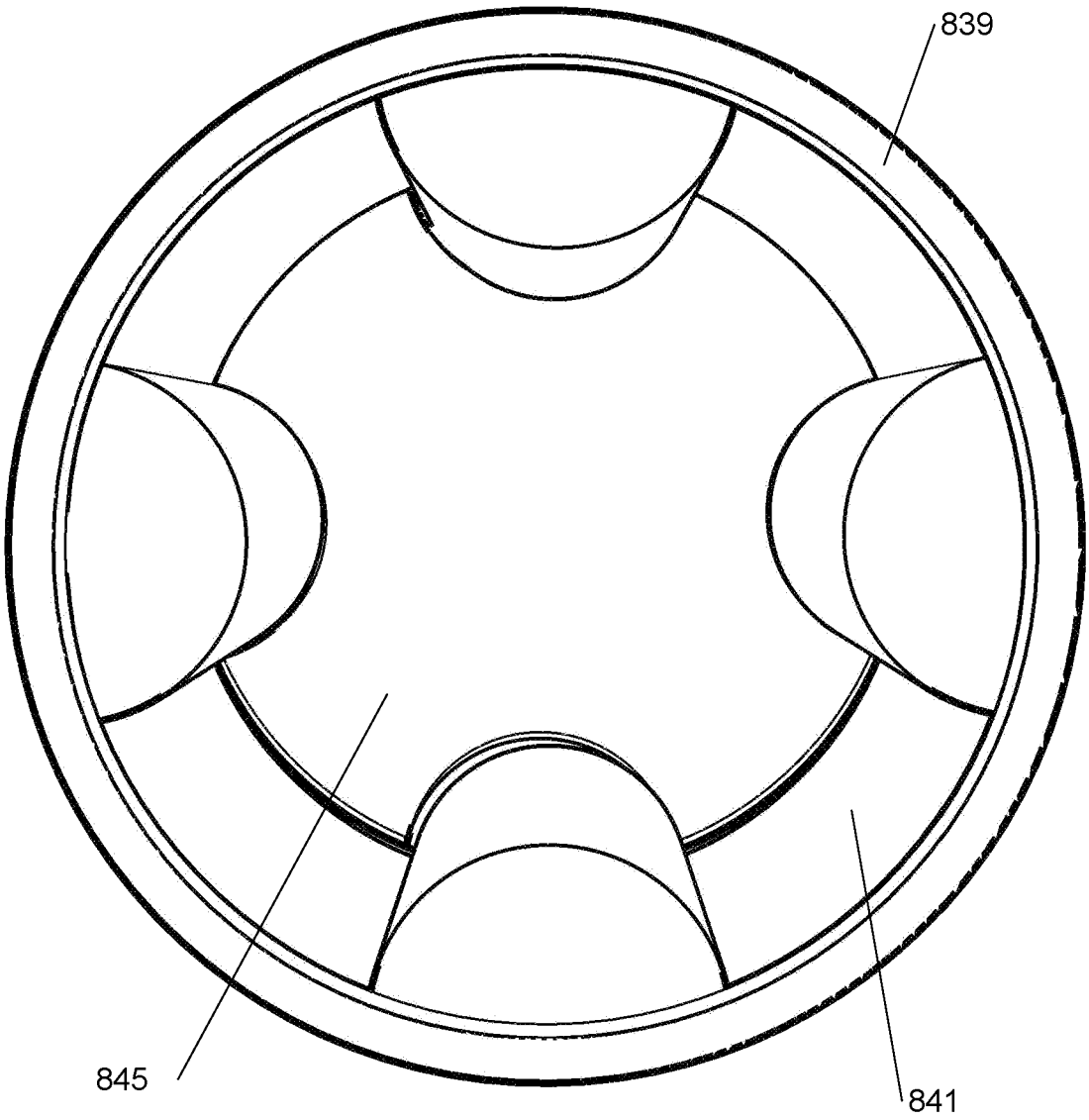

FIG. 32. Shows a front perspective close-up view of keyhole from inclusive component (857).

Figure 33A:
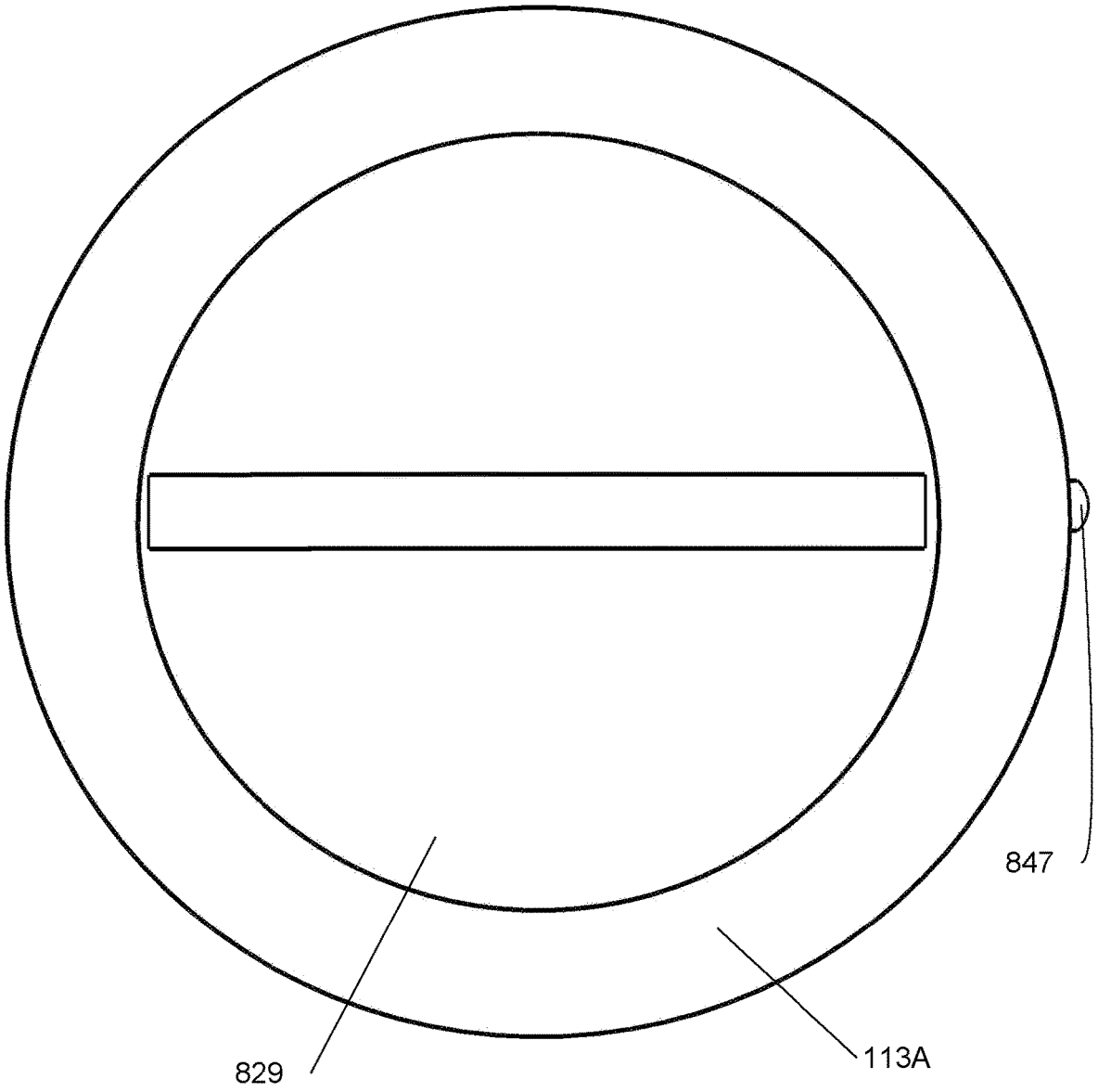

FIG. 33A. Shows a front view of knob when knob is not rotated to add resistance.

Figure 33B:
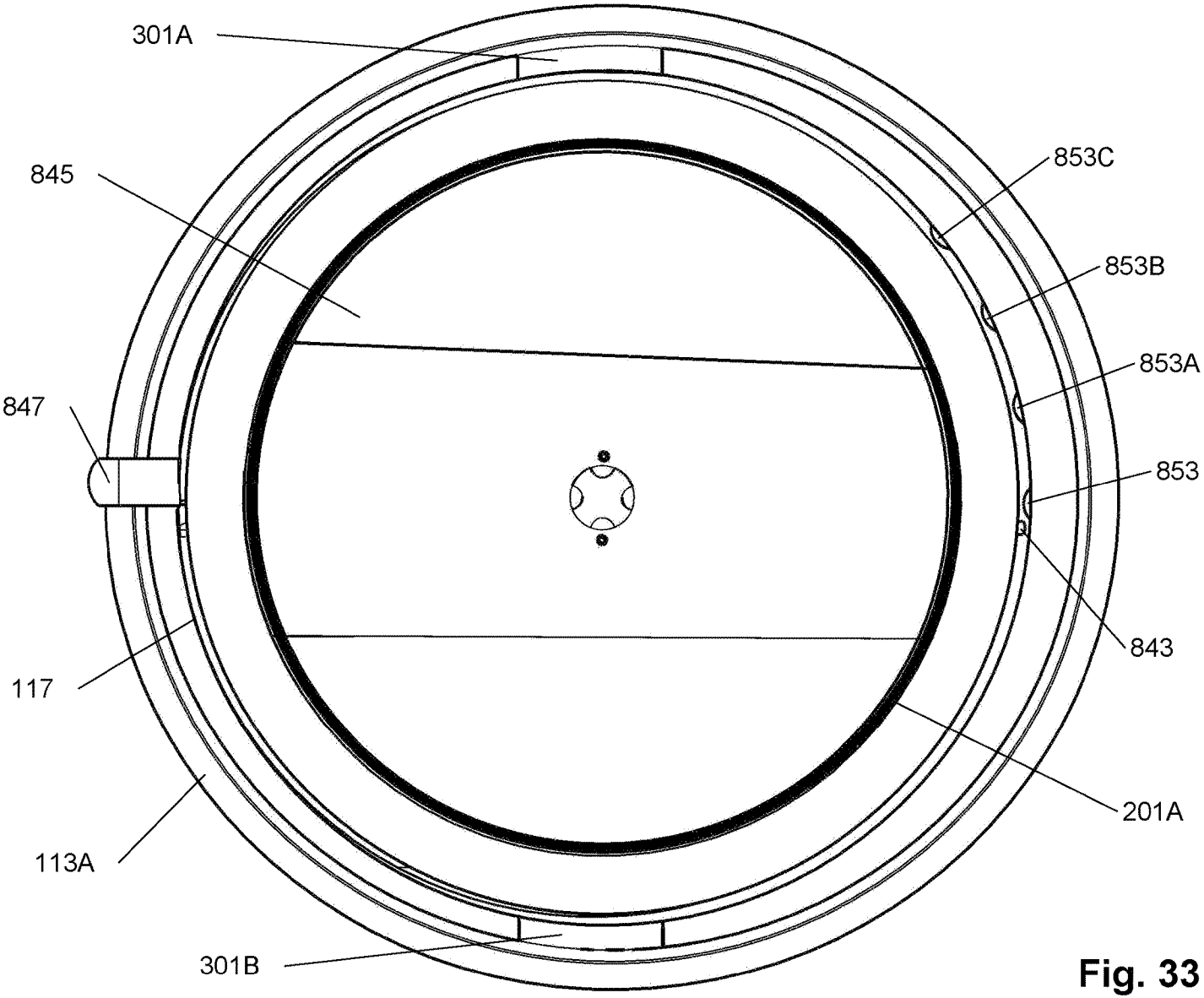

FIG. 33B. Shows a front view inside of ventral bar, when knob is not rotated.

Figure 33C:
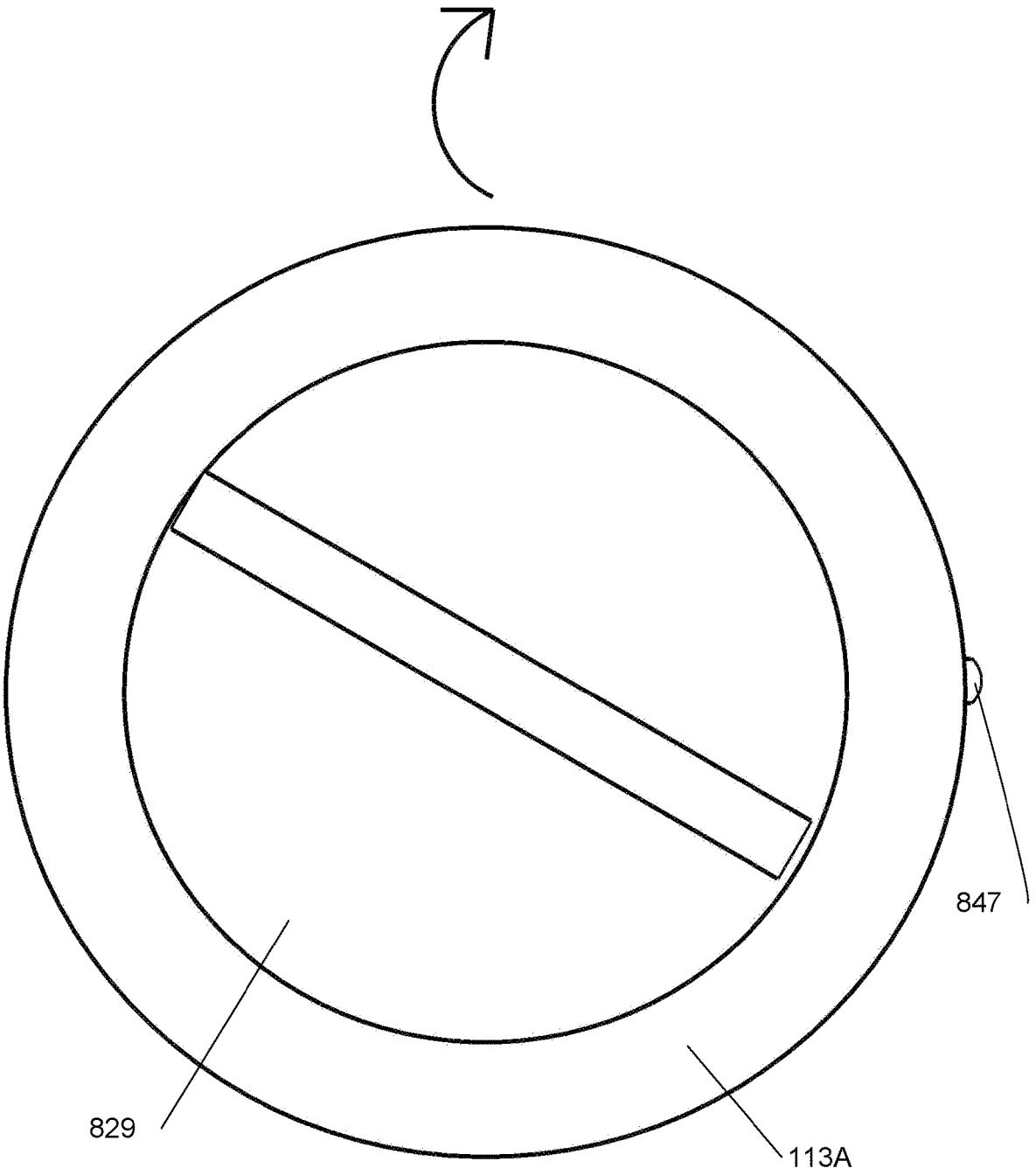

FIG. 33C. Shows a front view of knob rotated to add resistance, with arrow indicating direction of rotation.

Figure 33D:
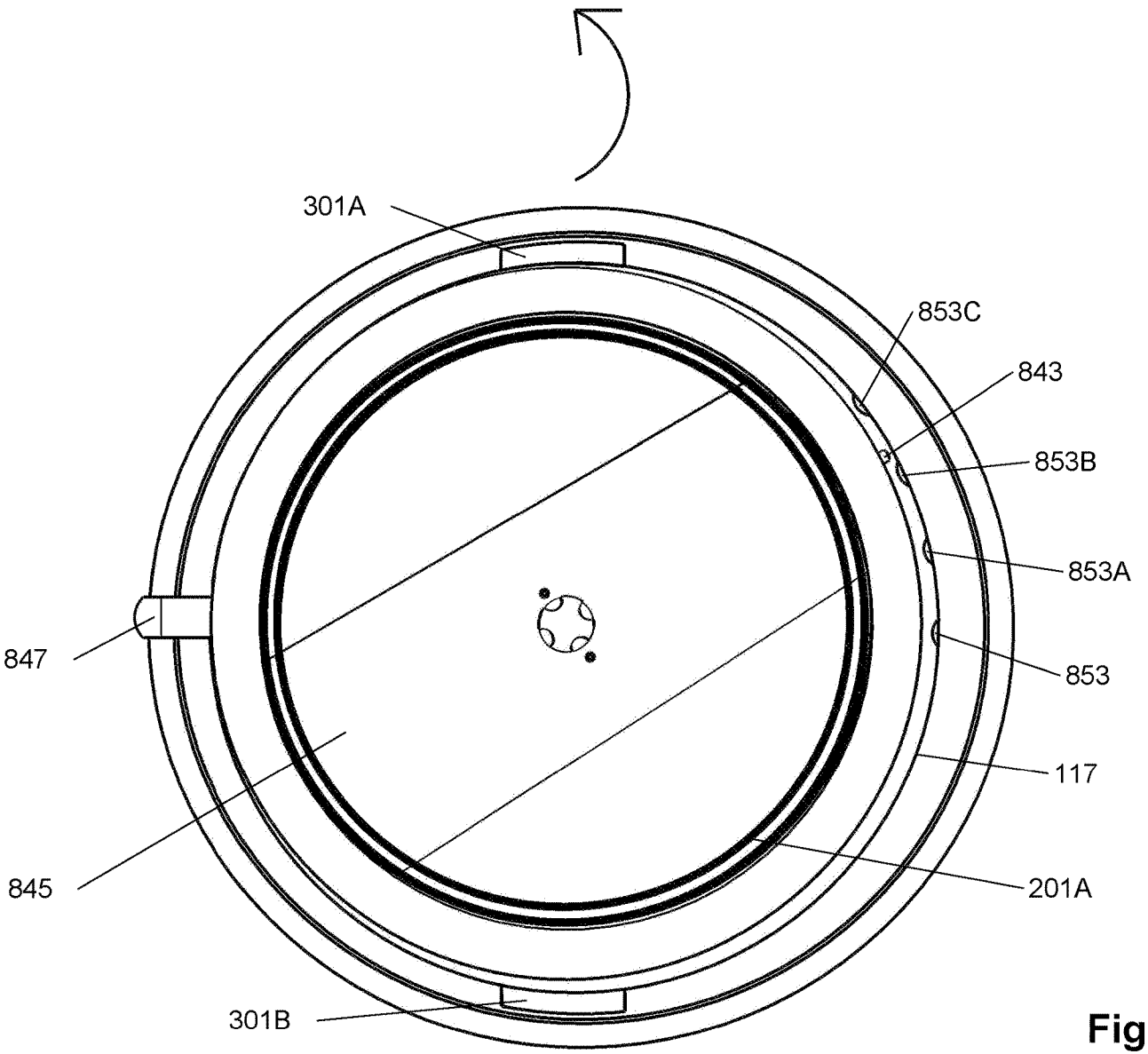

FIG. 33D. Shows a front view inside of ventral bar, when resistance is added, with arrow indicating direction of rotation.

DETAILED DESCRIPTION

Detailed description will commence with the first variation of disclosed fitness device, this will entail: how parts are assembled, the process of making, and how one can use the fitness device disclosed. The first variation will be followed by the second variation of claimed fitness device disclosed. The second variation will contain all utilitarian functions of first variation, with adjustable resistance. Also in the detailed description portion, there will be references to certain figures in different embodiments, to set forth how disclosed fitness device can be constructed in many ways without departing from the nature and scope of disclosed fitness device.

First Variation

FIG. 1. Shows fitness device 101 in preferred embodiment. Horizontal bars 121, 119A-B, and ventral bar 117, are shown welded to curved bar 105; in a different embodiment horizontal bars 121, 119A-B, and ventral bar 117 would connect to curved bar 105 by means of but not limited to bolts and nuts, for a more ergonomic way of packing fitness device 101. FIG. 2A-B shows fitness device 101 mounted on doorway 700 to be used for pull-up exercises. Rubber pegs 103-A will rest on door wall vertically, while rubber pegs 103B-C rest on door frame vertically (FIG. 2A-B). In a different embodiment ventral bar 117, may bend at its lateral ends, at an angle no greater than thirty degrees.

FIG. 3. Shows an exploded isometric view of fitness device 101. Rubber pegs 103-E will snap on horizontal bars 121, 119A-B, and ventral bar 117 at their respected medial and lateral ends. Compression spring caps 203B-C will reside in the cavity of ventral bar 117 at its medial end. One end of springs 201A-B will rest in compression spring caps 203B-C, while the other end of springs 201A-B will rest in compression spring caps 203-A, which will reside in ventral bar 117 lateral ends.

FIG. 9A-C shows how to lock components into the cavity of ventral bar 117. User will push locking caps 113A-B and compression spring caps 203-A thereby compressing springs 201A-B; before pushing locking caps 113A-B fixtures 301A-B must be at a different angle than locking fixtures 303-A (FIG. 9B), when fixtures 301A-B are anterior to locking fixtures 303-A user will then rotate locking caps 113A-B until fixtures 301A-B and locking fixtures 303-A are aligned (FIG. 9C), slowly decompress spring by decreasing force applied to locking caps 113A-B, and let go (FIG. 9C). Handgrips 109-A can either be at ventral bar 117 lateral or medial end to lock in components. In another embodiment rubber pegs 103D-E will be of the same width of rubber pegs 103-C. Also, in another embodiment locking caps 113A-B will be made from plastic.

FIG. 4A-B. Shows one embodiment of handgrips 109-A, in another claimed embodiment projections 503 and 501 which are used as a sliding mechanism for hand grips 109-A will be replaced with ball bearings 861 (FIG. 27). Appendage 505 will have dual sides in order to make contact with protuberance 601 (FIG. 6) from compression spring caps 203B and 203C for lateral sliding pull-ups (FIG. 8D-F), or lower back extension/sit-up assistance exercise (FIG. 15A-C); or appendage 505 will make contact with protuberance 601 from compression spring caps 203 and 203A for medial sliding pull-ups (FIG. 8A-C). Each handgrip 109-A will have indentations 111 to be used with lower back apparatus 817 (FIG. 16). Handgrips 109-A can be made from metal or plastic and have rubber covering. Handgrips 109-A will not be limited to cylindrical construct shown with disclosed drawings. Handgrips 109-A can be constructed to better conform to the user of device, as long as it sticks to the spirit and scope of disclosure stated.

FIG. 5A-B. While a reference for compression spring cap 203 is only named, the following description will also apply to compression spring caps 203-C since they are indistinguishable. FIG. 5A shows compression spring cap 203 in different states, more specifically FIG. 5A shows an explosive view of compression spring cap 203: concave spring cap 603 will go inside spring cap with outer rim 205. Referring now to FIG. 5B concave spring cap 603 and outer rim spring cap 205 are combined to make compression spring cap 203. Protuberance 601 of spring cap with outer rim 205 will be able to rotate independent of concave spring cap 603, rotation will be performed by means of appendage 505. (FIG. 10C, FIG. 10E).

Referring back to FIG. 8A-F shows the practical use of fitness device 101 in two different settings. To use for medial sliding pull-ups (FIG. 8A-C), the user will start from a hanging position with handgrips 109-A positioned at ventral bar 117 lateral ends, user will compress springs 201A-B (FIG. 8B) (while still hanging) until fully compressed (FIG. 8C) and handgrips 109-A are at ventral bar 117 medial end, user will then decompress springs 201A-B while lifting themselves up and creating distance between handgrips 109-A until handgrips 109-A are back at lateral starting position, this completes one repetition. In order to switch from medial sliding pull-ups to lateral sliding pull-ups (FIG. 8D-F), handgrips 109-A will have to be at the lateral ends of ventral bar 117, the user will then rotate handgrips 109-A up until projection 503 is in between track 135 (FIG. 11A), and projection 501 is in between track 131 (FIG. 12), then slide handgrips 109-A down ventral bar 117 to the medial end of ventral bar 117 (FIG. 11B), rotate handgrips 109-A down and perform exercise. To perform a lateral sliding pull-up (FIG. 8D-F) hang from handgrips 109-A, slide handgrips 109-A down ventral bar 117 compressing springs 201A-B, while doing this the user will be lifting themselves up until springs 201A-B are fully compressed (FIG. 8F) and handgrips 109-A are at ventral bar 117 lateral ends; user will then decompress springs 201A-B by sliding handgrips 109-A medially down ventral bar 117, while doing this the user will lower their body from pull-up position until springs 201A-B are fully decompressed and handgrips 109-A are returned to medial position in relation to ventral bar 117, this completes one repetition. While the preferred execution of performing a medial sliding pull-up and lateral sliding pull-up has been disclosed, it should be stated that the user can perform exercises in a variable of ways. Tracks 133, 135, 131, and 137 can be welded onto ventral bar 117.

The user will also be able to use fitness device 101 with static handgrips for pull-up exercises, by locking handgrips 109-A in "T" lock apertures 127. FIG. 10A-E gives a close-up view of the process, FIG. 10A-E also gives a close-up view of how fitness device 101 works from the perspective of handgrip 109 used in a medial sliding pull-up exercise. User of device will compress spring 201A which is carried out by appendage 505 pushing protuberance 601 medially down ventral bar 117 (FIG. 10A-B). When compression spring cap 203 reaches the middle of "T" lock aperture 127 (FIG. 10B), the user will rotate handgrip 109 up (FIG. 10C) decompress spring 201A by allowing it and handgrip 109 to travel horizontally left until protuberance 601 makes contact with "T" lock aperture arm 125A (FIG. 10D); then rotate handgrip 109 down to lock in (FIG. 10E) and use fitness device 101 with immovable handgrips for a more traditional pull-up exercise. When fitness device 101 is used for lateral sliding pull-ups (FIGS. 8D-F) and user wants to lock handgrips 109-A into "T" lock apertures 127, they will use "T" lock aperture arm 125B (FIG. 10-E).

Fitness device 101 has six "T" lock apertures 127, three for each side of ventral bar 117, they will be distinctly placed so the user will get the most benefit from location. For example, if handgrips 109-A were locked in "T" lock apertures 127 on ventral bar 117 lateral ends the user would perform a wide grip pull-up; if handgrips 109-A were locked in middle "T" lock apertures 127 the user can perform either medium grip pull-ups or chin-ups; and if handgrips 109-A were locked in medial "T" lock apertures 127 the user can perform either close grip pull-ups or close grip chin-ups. FIG. 10A-E shows medial sliding pull-up with just one handgrip 109, left side of ventral bar 117, and components of fitness device 101 inside cavity of ventral bar 117, it is my intention to make clear that the use of fitness device 101 just outlined above and in FIG. 10A-E applies to both sides of ventral bar 117. In a different embodiment, there will be an indication when handgrips 109-A are in position to lock into "T" lock apertures 127, indication can be but not limited to: markers that lie between "T" lock apertures 127, markers can equal or expand the width of handgrips 109-A to indicate when to rotate.

FIG. 14A-B shows clockwise rotation of rubber pegs 103-E. Depending on the exercise the user is performing determines the setting of rubber pegs 103-E; for example, as stated earlier rubber pegs 103-C will stand vertically to support hanging from door wall/frame (FIG. 2A-B). When the user of fitness device 101 is performing lower back extension or sit-up assistance exercises (FIG. 15A-C) rubber pegs 103B-C will stand vertically against door wall 800 and rubber pegs 103, 103A, 103D, and 103E will sit horizontally on floor so that fitness device 101 is elevated from ground (FIG. 15A-C).

To perform lower back extension and sit-up assistance exercise. Handgrips 109-A must be in lateral sliding pull-up position (FIG. 8D-F), before placing fitness device 101 on the floor the user will adjust rubber pegs 103-E to make sure they are at the right setting, as stated in previous paragraph. The user will then place fitness device 101 on the floor set against a vertical immovable structure, like a wall 800 (15A-C). User will then connect lower back apparatus 817 by placing lower back connector 805-A into indentations 111-A, as shown in FIG. 16 (lower back connector 805-A may snap into indentations 111-A; this statement is not meant to be limited in scope but to serve as an example of different embodiments of this invention that does not diverge from the spirit and scope of disclosed device). The user 809 will then sit on the floor, place their upper or mid-back on cushion 801, feet should be placed on the floor with arms behind your head or crossed on your chest for a traditional setting, and legs bent (FIG. 15A-B). The user 809 will then using only their upper back apply force to springs 201A-B causing the user to descend and extend their lower back (FIG. 15C), once fully extended the user 809 will ascend back to starting position with the assistance from springs 201A-B decompressing, and in doing so they are performing an assisted sit-up. Lower back apparatus 817 may be made from plastic or metal. In a different embodiment lower back apparatus 817 will be height adjustable, this can be done but not limited to "X" bars 803 constructed to become hollow cylindrical bars within another bar, so that each bar will have two cylindrical bars within each other, and below pin 827 (FIG. 21) will be pinholes going down vertically on each "X" bar 803, a pin for each bar can be assigned, to adjust height push pin into pinhole. Pin as well as cylindrical hollow bars may also be but not limited to being spring-loaded. Also, there is a possibility when user is engaging lower back apparatus that handgrips 109-A can rotate up into top "T" tracks (FIGS. 11A-B) and bottom "T" tracks (FIG. 12) to deal with this possible quandary in another embodiment device may come with one guardrail to prevent rotation. Guardrail may be but not limited to a mold of top "T" tracks affixed to an elongated piece of metal or plastic which spans the vertical section of tracks 133 and 135 where they converge (FIG. 11A-B). A guardrail may not be included with device, but another means to prevent rotation may come affixed to fitness device 101 or lower back apparatus 817. Also, lower back apparatus 817 may be constructed in a number of ways to those skilled in the art, but its function will serve the purpose as stated in mentioned specification and claims, this statement is not meant to limit the variable exercises one can perform with device.

FIG. 17-22 shows different perspectives of lower back apparatus 817 and its components. FIG. 17 shows left hinge 807 fixed to lower back connector 805 circled to detail the components of upcoming view. FIG. 18 shows hinge 807 fixed to one "X" bar 803. Hinge 807-A (FIG. 21) allows a better range of motion when lower back apparatus 817 descends (FIG. 15C) on a horizontal plane. FIG. 19 shows a back view of lower back apparatus 817 with its sliding mechanism circled. FIG. 20 shows sliding mechanism when user is either performing lower back extension or assisted sit-up exercises (FIG. 15A-C); cylindrical bar 811 fixed to "X" bar 803 will slide down compartment 825A during ascension (FIG. 15C), on the right side of "X" bar 803 the same movement is occurring in compartment 825B (FIG. 19). In another embodiment rollers or ball bearings may take the place of cylindrical bar 811.

Second Variation

FIG. 23 shows a front view of second variation of fitness device 101. If you refer back to FIG. 16 you will notice the only visual difference, besides the lower back apparatus 817, are knobs 829-A at each lateral end of ventral bar 117. Knobs 829-A will start out in a neutral position (no resistance added) (FIG. 33A-B), if the user would like to increase resistance they will engage knobs 829-A by rotating them clockwise (FIG. 33C-D) decreasing the diameter of springs 201A-B, in so doing increasing compression resistance from springs 201A-B which the user will feel when engaging device. When the user rotates knobs 829-A (FIG. 33C-D) in order to engage resistance, circular gear protuberance 843 from circular gear 841 will occupy one track of tracks 853-C (FIG. 33D), the user can then either perform: a medial resistance pull-up (FIG. 8A-C) a lateral resistance pull-up (FIG. 8D-F) or a lower back extension/sit-up assistance resistance exercise (FIG. 15A-C). In order to decrease resistance inclusive component 857 will have to return back to lateral ends of ventral bar 117, once returned, key 833 will go into keyhole (FIG. 32) user will then rotate knobs 829-A accordingly. In order for springs 201A-B to rotate, springs 201A-B will fit tightly into inclusive components 857.

FIG. 24 shows the inner tracks 853-C for ventral bar 117, tracks 853-C will be placed parallel to one another and run from ventral bar 117 lateral end to its medial end, on both sides of ventral bar 117. Tracks 853-C can be metal, and may be welded onto ventral bar 117, but not limited to that option. Tracks will not be limited to four.

FIG. 25 shows the posterior side of component 857. As in the first variation, there will be a total of four inclusive components 857, one at each lateral end of springs 201A-B. Also as in the first variation, circular cap protuberance 847 will make contact with appendage 505 to compress springs 201A-B (there is a difference in reference numbers between outer rim spring cap 205 (FIG. 5A) and circular cap 839 (FIG. 26), because circular cap 839 has a circular aperture in its middle) to engage fitness device 101 for exercise or to lock in "T" locks 127 (FIG. 10A-E).

FIG. 26 shows inclusive component 857 broken up. Circular gear 841 and spring gear cap 845 may be connected by screws 849 and bolts 851. Circular gear 841 rectangular feature will insert into spring gear cap 845 rectangular feature and act in dual motion, meaning, when circular cap 839 is rotated do to circular cap protuberance 847 it will act independently from circular gear 841 and spring gear cap 845. Referring back to FIG. 33D shows an example of the last statement: circular gear protuberance 843 from circular gear 841 was rotated and circular cap protuberance 847 from circular cap 839 did not rotate. Spring gear cap 845 key structure located in the middle of spring gear cap 845 (FIG. 26) may be a keyhole indentation or a keyhole aperture identical to circular gear 841 keyhole aperture (FIG. 26). In another embodiment circular cap 839 and spring gear cap 845 can link, linking means can be but not limited to spring gear cap 845 having a concave dome similar to concave spring cap 603 and inserted into circular cap 839. Spring gear cap 845 would have circular gear protuberance 843 and serve the same utilitarian function as above disclosure mentioned, in this embodiment circular cap 839 would still act independently from spring gear cap 845 when spring gear cap 845 is rotated. Aforementioned statement is not meant to be limiting but to describe how disclosed fitness device can be configured in a number of ways by those skilled in the art without departing from the scope and nature of disclosed fitness device.

Knobs 829-A will work independently of locking caps 113A-B, referring to FIG. 29-30 shows this process. FIG. 29 shows direction of where knob 829 and its fixed cylindrical protuberance 831 will be inserted, which is a circular hollow aperture in the middle of locking cap 113A. Once inserted circular ring 837 will either be tightened onto cylindrical protuberance 831 or welded (FIG. 30), but are not limited to those options. Screw 835 may also secure key 833 to circular protuberance 831 (FIG. 30), but is not limited to that option. FIG. 28A-B shows different views of knob 829 combined with locking cap 113A. FIG. 31 shows cylindrical protuberance 831 direction of entry for key 833 into keyhole (FIG. 32).

The utilitarian ability of inclusive component 857 is accomplished through its distinct key system, which can be designed in many ways to those skilled in the art, but for intent and purposes, its function is that of a key system, which is part of above disclosure. Also there are many ways one skilled in the art can configure aforementioned fitness device, for instance in the second variation: instead of circular gear 841 having a rectangular feature and spring gear cap 845 having indentations to link with rectangular feature, circular gear 841 can have notches going along its frame and spring gear cap 845 can have notches on its posterior side to link with circular gear notches, said notches will serve as a means to twist springs 201A-B when rotated eliminating the need for tracks 853-C, instead, there will be one set of tracks for circular gear protuberance 843 to prevent rotation from circular gear 841 when engaged. In other words, this would eliminate the need for multiple tracks to increase resistance inside ventral bar 117, but it would still serve the same utilitarian function of multiple tracks. This statement is not meant to be limiting but to describe how above mentioned disclosure can be configured in a number of ways to those skilled in the art without departing from the spirit and scope of claimed fitness device.

The inventor claims:

1. A fitness device comprising:

a curved bar having first and second horizontal bars and a ventral bar attached transversely thereto;

said first horizontal bar being connected at a first end of said curved bar, said ventral bar connected at a second end of said curved bar and second horizontal bar being between said first and second ends of said curved bar, said first and second horizontal bar having rubber pegs respectively mounted at each of the lateral ends thereof configured to rest against a door frame;

said ventral bar further comprising:

rubber pegs mounted medially on said ventral bar;

two slots along a length of said ventral bar on each side of said medially mounted pegs; the slots having "T" shaped apertures spaced along said slots, said apertures having a top arm with depending arm extending vertically down, at each lateral end of said top arm;

a locking cap at each lateral end thereof;

said locking caps will have a knob;

said knobs will act independent of said locking caps;

a cavity with two springs housed within said cavity;

said knobs utility will be to twist said springs;

tracks to assist resistance levels will be housed within said cavity;

said springs supported by means for compressing said springs, said means will be placed at the lateral ends of each said spring;

two handgrips, each handgrip movably mounted to a respective slot of said two slots against a bias of a respective spring of said two springs such that the handgrips are configured to travel within the slots on a horizontal plane and are configured to rotate up or down on a vertical plane within said "T" shaped apertures to lock said handgrips in place;

and tracks on a top surface of said ventral bar and bottom surface of said ventral, to stabilize and support movement of handgrips along said ventral bar.

2. The fitness device of claim 1, wherein said horizontal bars are configured to support said device hanging from door wall/frame with attached rubber pegs when used for pull-up exercises, and said horizontal bars support floor placement with attached said rubber pegs when engaged in exercise.

3. The fitness device of claim 1, further comprising tracks housed within said cavity of said ventral bar placed horizontally on said ventral bar, said tracks begin at lateral ends of said ventral bar and conclude at medial ends of said ventral bar; said tracks are partitioned.

4. The fitness device of claim 1, wherein said knobs are connected to a cylindrical protuberance from a center of said knobs; distal from knobs located on cylindrical protuberance head, is an appendage that has a distinct form, for purposes of utility said appendage will be defined as a key.

5. The fitness device of claim 1, further comprising a circular cap, a circular gear, and a spring gear cap combine to form an inclusive component.

6. The fitness device of 5, wherein said circular cap will act independent from circular gear, and spring gear cap, when said circular cap said circular gear and said spring gear cap combine to form an inclusive component.

7. The fitness device of claim 5, wherein said circular gear has a protuberance said protuberance utility stabilizes said circular gear and said spring gear cap when rotated.

8. The fitness device of claim 5, wherein said spring gear cap has a key structure, said structure form serves as a key lock to form an inclusive component.

9. The fitness device of claim 1, wherein said circular cap has a circular aperture.

10. The fitness device of claim 1, wherein said circular cap has a protuberance, said protuberance makes contact with appendage to compress springs.

11. The fitness device of claim 1, wherein said circular gear and spring gear cap forms one gear.

12. The fitness device of claim 1, wherein said circular gear has a circular aperture, said circular aperture has a distinct form that serves as a medium, said circular aperture serves as a keyhole.

* * * * *